US007762817B2

(12) United States Patent
Ligtenberg et al.

(10) Patent No.: US 7,762,817 B2
(45) Date of Patent: Jul. 27, 2010

(54) SYSTEM FOR COUPLING INTERFACING PARTS

(75) Inventors: Chris Ligtenberg, San Carlos, CA (US); John C. DiFonzo, Emerald Hills, CA (US); Brett William Degner, Menlo Park, CA (US); John Brock, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/239,662

(22) Filed: Sep. 26, 2008

(65) Prior Publication Data

US 2009/0174990 A1 Jul. 9, 2009

Related U.S. Application Data

(60) Provisional application No. 61/010,769, filed on Jan. 11, 2008, provisional application No. 61/010,116, filed on Jan. 4, 2008.

(51) Int. Cl.
*H01R 11/30* (2006.01)

(52) U.S. Cl. ..... 439/38

(58) Field of Classification Search ..... 439/38, 439/39, 40, 505, 519; 361/733
See application file for complete search history.

(56) References Cited

U.S. PATENT DOCUMENTS

| | | | |
|---|---|---|---|
| 2,170,287 | A | 8/1939 | Kinnebrew |
| 2,234,982 | A | 3/1941 | Ross |
| 2,471,634 | A | 5/1949 | Mark et al. |
| 2,840,408 | A | 6/1958 | Scott et al. |
| 3,363,214 | A | 1/1968 | Wright |
| 3,431,428 | A | 3/1969 | Valer |
| 3,468,576 | A | 9/1969 | Beyer et al. |
| 3,521,216 | A | 7/1970 | Tolegian |
| 3,652,886 | A | 3/1972 | Riordan et al. |
| 3,786,391 | A | 1/1974 | Mathauser |
| 3,790,197 | A | 2/1974 | Parker |

(Continued)

FOREIGN PATENT DOCUMENTS

| | | |
|---|---|---|
| DE | 102 42 645 | 3/2004 |

(Continued)

OTHER PUBLICATIONS

CNN.com, "Break-away cord aims to make deep fryers safer," obtained from http://archives.cnn.com/2001/US/07/03/deep.fryers/, dated Jul. 4, 2001, 2-pgs.

(Continued)

*Primary Examiner*—Chandrika Prasad
(74) *Attorney, Agent, or Firm*—Townsend and Townsend and Crew LLP

(57) ABSTRACT

An electronic device is disclosed. The electronic device includes a first subassembly having a first housing component. The first housing component has an opening. The electronic device also includes a second subassembly having a second housing component. The second housing component cooperates with the first housing component to enclose components of an electronic device. The at least one internal component is also movable relative to the second subassembly so as to properly align with the opening. The at least one internal component is additionally magnetically attracted towards the first housing component near the opening.

28 Claims, 15 Drawing Sheets

U.S. PATENT DOCUMENTS

| | | | | |
|---|---|---|---|---|
| 3,808,577 | A | 4/1974 | Mathauser | |
| 3,810,258 | A | 5/1974 | Mathauser | |
| 3,868,160 | A | 2/1975 | Kersman | |
| 4,211,456 | A | 7/1980 | Sears | |
| 4,317,969 | A | 3/1982 | Riegler et al. | |
| 4,669,791 | A | 6/1987 | Savill | |
| 4,810,202 | A | 3/1989 | Nodfelt | |
| 5,382,167 | A | 1/1995 | Janson, Jr. | |
| 5,385,476 | A | 1/1995 | Jasper | |
| 5,692,786 | A | 12/1997 | Berger | |
| 5,803,751 | A | 9/1998 | Liu | |
| 5,812,356 | A | 9/1998 | O'Connor | |
| 5,829,987 | A | 11/1998 | Fritsch et al. | |
| 5,921,783 | A | 7/1999 | Fritsch et al. | |
| 5,941,729 | A | 8/1999 | Sri-Jayantha | |
| 5,954,520 | A | 9/1999 | Schmidt | |
| 6,030,229 | A | 2/2000 | Tsutsui | |
| 6,042,385 | A | 3/2000 | Watanabe et al. | |
| 6,183,264 | B1 | 2/2001 | Harsanyi | |
| 6,217,339 | B1 | 4/2001 | Tsubata | |
| 6,219,267 | B1 | 4/2001 | Andres | |
| 6,250,931 | B1 | 6/2001 | Mendelson | |
| 6,267,602 | B1 | 7/2001 | Mendelson et al. | |
| 6,340,302 | B1 | 1/2002 | Ladd | |
| 6,464,509 | B1 | 10/2002 | Emberty et al. | |
| 6,478,614 | B1 | 11/2002 | De'Longhi | |
| 6,527,570 | B1 | 3/2003 | Hartman et al. | |
| 6,528,746 | B2 | 3/2003 | DeWitt et al. | |
| 6,561,815 | B1 | 5/2003 | Schmidt | |
| 6,607,391 | B2 | 8/2003 | Mendelson et al. | |
| 6,623,276 | B2 | 9/2003 | Dalmau Ferrerfabrega et al. | |
| 6,653,919 | B2 | 11/2003 | Shih-Chung et al. | |
| 6,727,477 | B1 | 4/2004 | Li-Chen | |
| 6,821,126 | B2 | 11/2004 | Neidlein | |
| 6,966,781 | B1 | 11/2005 | Bullinger et al. | |
| 6,971,147 | B2 | 12/2005 | Halstead | |
| 6,976,882 | B2 | 12/2005 | Kernan | |
| 6,988,897 | B2 | 1/2006 | Belongia et al. | |
| 7,002,074 | B2 | 2/2006 | Settergren et al. | |
| 7,032,288 | B2 | 4/2006 | Ladd | |
| 7,112,103 | B2 | 9/2006 | Zhang et al. | |
| 7,250,207 | B1 | 7/2007 | Heal et al. | |
| 7,311,526 | B2 | 12/2007 | Rohrbach et al. | |
| 7,351,066 | B2 | 4/2008 | DiFonzo et al. | |
| 7,467,948 | B2 * | 12/2008 | Lindberg et al. | 439/38 |
| 2002/0048982 | A1 | 4/2002 | Gu et al. | |
| 2003/0148643 | A1 | 8/2003 | Yoji | |
| 2004/0184295 | A1 | 9/2004 | Robertson et al. | |
| 2004/0209489 | A1 | 10/2004 | Clapper | |
| 2004/0257741 | A1 | 12/2004 | Cuny et al. | |
| 2005/0208783 | A1 | 9/2005 | Suzuki et al. | |
| 2005/0255718 | A1 | 11/2005 | McLeish | |
| 2005/0255719 | A1 | 11/2005 | Heidlein | |
| 2006/0006674 | A1 | 1/2006 | Kang et al. | |
| 2006/0051981 | A1 | 3/2006 | Neidlein et al. | |
| 2007/0072443 | A1 * | 3/2007 | Rohrbach et al. | 439/39 |
| 2007/0138806 | A1 | 6/2007 | Ligtenberg et al. | |

FOREIGN PATENT DOCUMENTS

| | | |
|---|---|---|
| DE | 103 33 403 | 8/2004 |
| EP | 0 289 208 | 11/1988 |
| GB | 2264975 | 9/1993 |
| JP | 03-059973 | 3/1991 |
| JP | 05-335051 | 12/1993 |
| JP | 2002056929 | 2/2002 |
| WO | WO 2009/088833 A1 | 7/2009 |

OTHER PUBLICATIONS

Dowell Trading Co, Ltd., "News for "Break Away" Power Cords on Electric Deep Fryers," copyright 2002, 1-pg.

U.S. Appl. No. 61/010,116, Ligtenberg et al.

U.S. Appl. No. 61/010,769, Ligtenberg et al.

National Presto Industries, Inc., "Magnetic Cord for Electric Deep Fryers," obtained from http://www.gopresto.com/products.php?stock=09982, generated Jan. 18, 2006, 1-pg.

"Presto 9984 Control Master Heat Control with Magnetic Cord," obtained from http://www.cookingandcanning.net/pr99comaheco.html, generated Jan. 18, 2006, 1-pg.

U.S. Consumer Product Safety Commission, "Consumer Product Safety Review," Winter 2002, vol. 6, No. 3, total of 12-pgs., see p. 5.

"Zojirushi Hot Water Dispensing Pot Review," obtained from http://www.pkshiu.com/lof/archive/2005/01/zojirushi-hot-water-dispensing-- pot-review, dated Jan. 5, 2005, 2-pgs.

PCT Search Report of the International Searching Authority for Application No. PCT/US/2008/088454; mailed on May 20, 2009; 3 pages.

PCT Written Opinion of the International Searching Authority for Application No. PCT/US/2008/088454; mailed on May 20, 2009; 6 pages.

* cited by examiner

SYSTEM FOR COUPLING INTERFACING PARTS

This application claims the benefit of U.S. Provisional Patent Application No. 61/010,116, filed Jan. 4, 2008, and also claims the benefit of U.S. Provisional Patent Application No. 61/010,769, filed Jan. 11, 2008, both of which are incorporated herein by reference in their entirety.

FIELD OF THE INVENTION

The present invention relates generally to electronic devices. More particularly, the present invention relates to coupling interfacing parts of an electronic device.

BACKGROUND OF THE INVENTION

Electronic devices such as portable computers, phones, and media players continue to grow more powerful while shrinking in size and weight. The trend toward smaller, lighter and more powerful electronic devices presents a continuing challenge in the design and manufacture of some components associated with such electronic devices. For example, the design of the enclosures used to house the various internal components of the portable computer is becoming more and more challenging. This design challenge generally arises from two conflicting goals: the desirability of making the enclosure light, small, and thin, versus the desirability of making the enclosure strong and rigid. In most electronic devices, the enclosures are mechanical assemblies having parts that are screwed, riveted, snapped or otherwise fastened together at discrete points. Light-weight enclosures, which use thin walls and a small amount of fasteners, tend to be more flexible. Therefore, light-weight enclosures have a greater propensity to buckle and bow during use, while stronger and more rigid enclosures, which use thicker walls and more fasteners, tend to be bulkier and heavier. Accordingly, "smaller and lighter" poses manufacturability challenges while "heavier and bulkier" runs counter to principles of industrial design as dictated by consumer expectations.

Furthermore, the level of integration and processing sophistication of integrated circuit devices has increased, as has the level of signal interferences, and other types of noise, including electromagnetic interference. In order to minimize undesirable interference, the enclosures are often shielded with an electrically conductive material to block the emission of electromagnetic radiation, which emanates from the integrated circuit devices. Additionally, in order to seal the interface of mating parts of the enclosure, silicone-based electrically conductive electromagnetic interference (EMI) gaskets may be formed in place, between two parts, before an enclosure is assembled. One example of an electrically conductive EMI gasket is the Form-In-Place Gasket™ manufactured by 3M Company. EMI shielding also may suffer from some of the aforementioned adverse effects of "thinner and lighter" devices. For example, bowing may break an EMI seal, or create gaps at the interface of mating parts, for example, between a pair of interfacing casings.

BRIEF SUMMARY OF THE INVENTION

The invention relates, in one embodiment, to an electronic device. The electronic device may include a first subassembly having a first housing component. The first housing component may include an opening. The electronic device also may include a second subassembly having a second housing component. The second housing component may cooperate with the first housing component to enclose components of an electronic device. At least one internal component may be accessible through the opening. The at least one internal component may also be movable relative to the second subassembly so as to properly align with the opening. The at least one internal component may additionally be magnetically attracted towards the first housing component near the opening.

The invention relates, in another embodiment, to a system for coupling first and second disparate parts. The system may include a wall. The system also may include a movable component that is physically distinct from but movable relative to the wall. The movable component may move into mating engagement with the wall during an assembly condition.

The invention relates, in yet another embodiment, to a system for coupling first and second disparate parts. The system may include a wall having a magnetic element. The system also may include an internal component housed within the wall. The internal component may be structurally distinct from the wall. The internal component may have a corresponding magnetic element that is magnetically attracted to the magnetic element of the wall. The magnetic attraction may hold the internal component relative to the wall in an assembled state.

The invention relates, in a further embodiment, to a blind mating feature that promotes self assembly between two parts via a magnetic force.

The invention relates, in another embodiment, to a system for stitching two parts of an enclosure together via magnetic force.

The invention relates, in yet another embodiment, to an electronic device having a first housing component and a second housing component that form an enclosure. The electronic device may include a movable internal component disposed between the first housing component and the second housing component. The electronic device may also include a blind mating system that promotes self assembly between the movable internal component and at least one of the first and second housing components when the first and second housing components are assembled together to form the enclosure of the electronic device.

The invention relates, in yet another embodiment, to an electronic device, which may include a first housing having an opening, a second housing which may include a first mounting point, the second housing cooperating with the first housing to form an enclosure, a functional component which may include at least one magnetic element, and being located internal to the enclosure, and being movably coupled to the first mounting point, and wherein the functional component may magnetically couple with the first housing to movably align the functional component with the opening.

The invention relates, in yet another embodiment, to a method for assembling an electronic device, which may include coupling a functional component to a first housing. The functional component may include at least one magnetic element, wherein the functional component may be movable in relation to the first housing, and mounting a second housing to the first housing to form at least a portion of an enclosure of an electronic device. The enclosure at least may partially enclose the functional component. The second housing may include an opening for the functional component, wherein the functional component may magnetically couple with the second housing to automatically align with the opening.

The invention relates, in yet another embodiment, to an electrical device, which may include a first wall of an electronic device. The first wall may include a wall opening, an insert attached to the first wall. The insert may include an insert opening aligned with the wall opening. The insert may include a first aligning element at least partially surrounding the insert opening. The insert may include at least one first magnetic element, a second wall of an electronic device. The second wall and first wall may form at least a portion of an enclosure of an electronic device, a connector base movably attached to the second wall. The connector base may include at least one second magnetic element. The connector base may include at least one second aligning element which aligns with the first aligning element, and a connector attached to the connector base. The at least one second magnetic element magnetically may couple with the at least one first magnetic element to move and automatically align the first and second aligning elements when the first and second walls form at least a portion of an enclosure.

The invention relates, in yet another embodiment, to a connector system, which may include a first wall of an electronic device. The outer wall may include a wall opening on at least a partially curved portion of the first wall. An insert may be attached to the outer wall. The insert may include an insert opening aligned with the wall opening by a lip. The insert may include a first chamfered surface surrounding the insert opening. The insert may include two flanged portions, each flanged portion including a ferromagnetic surface, a second wall of an electronic device. The second wall and first wall may form at least a portion of an enclosure of an electronic device, a connector base which may be movably attached to a portion of the second wall. The connector base may include at least one second magnetic element. The connector base may include a second chamfered surface which aligns with the first chamfered surface, and a power connector may include a magnetic attachment system for attaching to an external power cord. The power connector may be attached to the connector base, wherein the power connector may be accessible through the insert opening through the curved portion of the first wall after the first and external walls form at least a portion of an enclosure, and wherein the magnets may magnetically couple with the ferromagnetic surfaces to move and automatically align the first and second chamfered surfaces when the first and second walls form at least a portion of an enclosure, and wherein the opening of the insert and the connector base may be aligned within a first tolerance range, and the connector base and the second wall may be aligned within a second tolerance range, the movement of the connector base may be limited within the second tolerance range, and the second tolerance range may be greater than the first tolerance range.

For a further understanding of the nature and advantages of the invention, reference should be made to the following description taken in conjunction with the accompanying figures. It is to be understood, however, that each of the figures is provided for the purpose of illustration and description only and is not intended as a definition of the limits of the embodiments of the present invention.

DETAILED DESCRIPTION OF THE INVENTION

Figure 1:
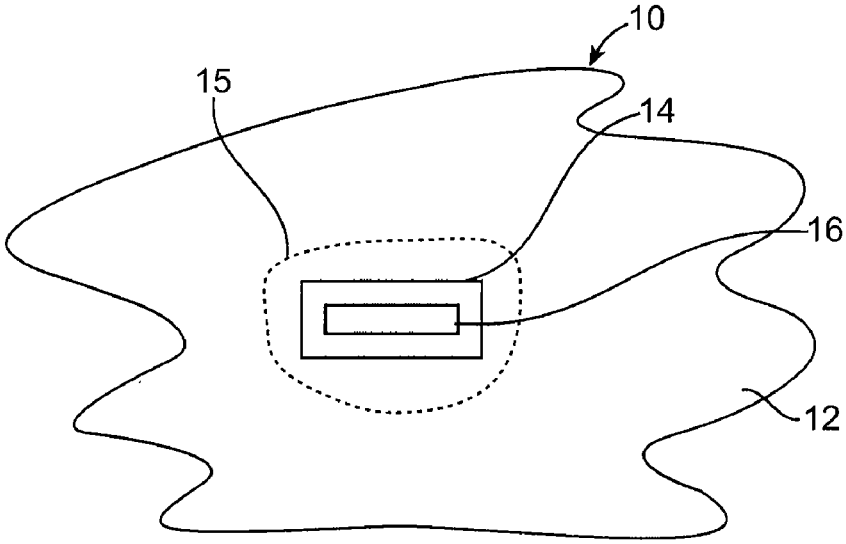
FIG. 1 is a broken away and highly simplified diagram of a portion of an electronic device, in accordance with one embodiment of the present invention.
Figure 2A:
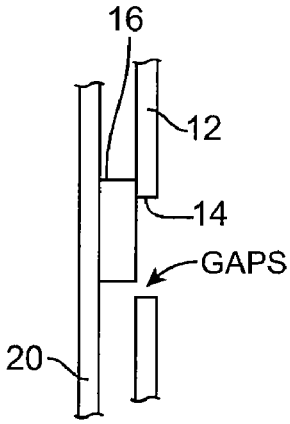
FIGS. 2A-2E are examples of undesirable cracks, gaps, recesses, protrusions and bowing that can occur between an internal component and an opening in an interfacing wall.
Figure 2B:
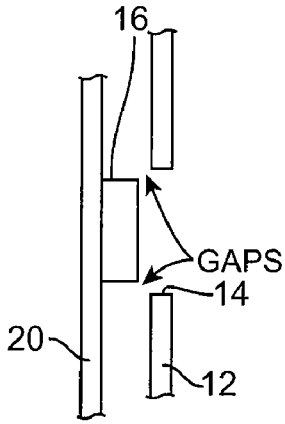
Figure 2C:
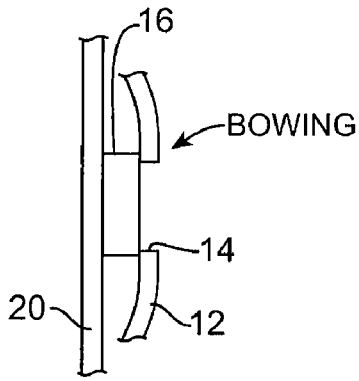
Figure 2D:
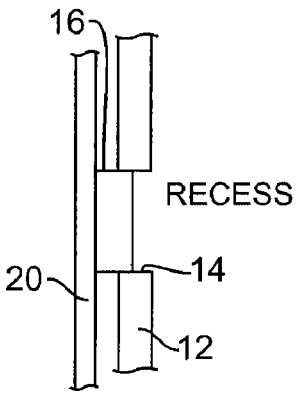
Figure 2E:
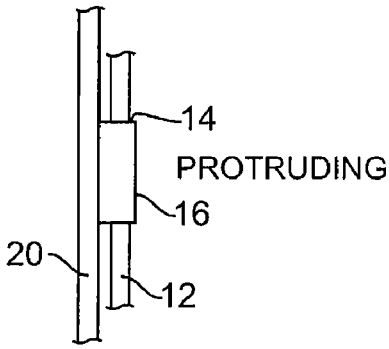
Figure 3:
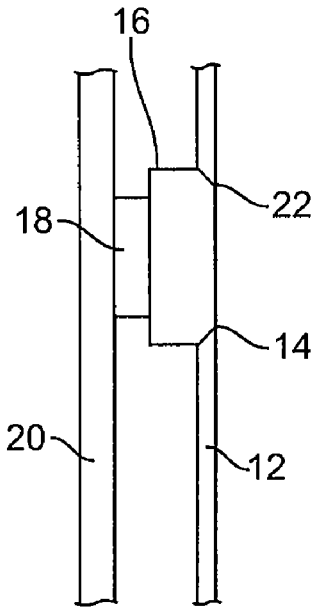
FIG. 3 is a simplified diagram of a movable internal component interfacing with a wall, in accordance with one embodiment of the present invention.
Figure 4A:
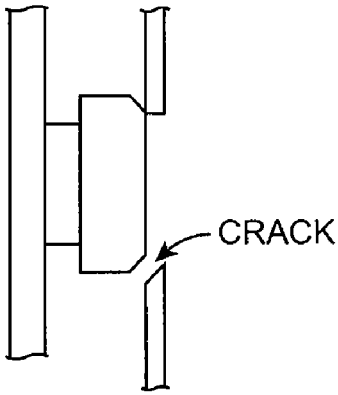
FIGS. 4A-4D are examples showing an internal component shifting away from an offset position into mating engagement with a wall, in accordance with one embodiment of the present invention.
Figure 4C:
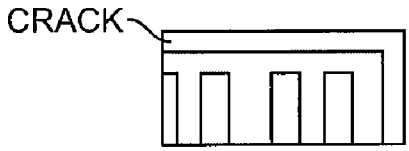
Figure 4B:
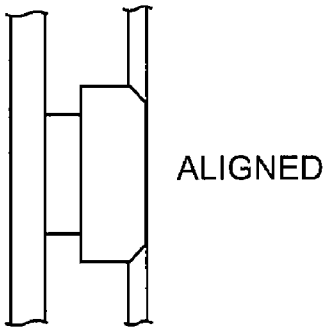
Figure 4D:
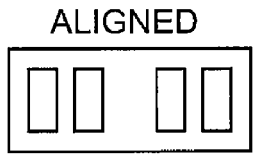

FIG. 1 is a highly simplified broken away diagram of a portion 10 of an electronic device, in accordance with one embodiment of the present invention. The portion 10 may represent an exterior surface of the electronic device. By way of example, the electronic device may correspond to any consumer electronic product such as computers, phones, media players, and the like.

As shown, the portion 10 of the electronic device may include a wall 12 with a user accessible I/O region 15. The wall 12 may, for example, be an exterior housing wall of the electronic device, and the I/O region 15 may allow interaction and accessibility between the outside world and the electronic device. Accessibility to the I/O region 15 may include a physical interaction with the electronic device, e.g., a connection or button, and/or a non-contact energy interaction, e.g., visible light detection, infrared light signals. The I/O region 15 may be widely varied. In one embodiment, the I/O region 15 may represent one or more connector devices, such as power and/or data connectors (e.g., DC, AC, USB, Firewire, AV jacks, card slots, network, display, etc.). In another embodiment, the I/O region 15 may represent one or more input devices and/or output devices, such as buttons, touch pads, trackballs, displays, keys, infrared sensors, LED indicators, etc. Any combination of single and multiple devices may be used.

In accordance with one embodiment, the I/O region 15 may be formed by disparate unique parts that are brought together during assembly of the electronic device, for example, parts that are not structurally attached or physically fastened to one another. The I/O region 15 may, for example, be formed by at least a portion of the wall 12 and an internal component 16 located at an opening 14 in the wall 12 (the wall/opening and the internal component can work together to define the I/O region in the portion of the electronic device). The opening 14 may, for example, be dimensioned to provide access to the internal component 16, which can be disposed within the electronic device. In some cases, at least a portion of the internal component 16 can be placed through the opening 14 while in other cases the internal component 16 can be placed behind the wall 12 but in front of the opening 14. The internal component 16 configuration may depend on the configuration of the I/O region 15. For example, in the case of an I/O region configured as a connector, the internal component(s) may be an electrical contact assembly that cooperates with the wall/opening 12/14 to form the connector. In some cases, the side surfaces of the wall at the opening may even define a mating region for a corresponding external connector (e.g., void for receiving protruding portion of corresponding connector). In addition, in the case of an I/O region configured as an input device such as a button, the internal component(s) may be a movable button cap/dome switch assembly that cooperates with the wall/opening 12/14 to form the button. In essence, any connector assembly, input assembly, output assembly and/or other related assembly can cooperate with the wall/opening 12/14.

In one embodiment, the placement of the wall relative to the internal component can be made during assembly of the electronic device. The wall may, for example, be a removable or detachable component that is fastened to another part or structure that includes the internal component. In one example, the electronic device can include a first subassembly that is fastened to a second subassembly (e.g., screws, snaps, etc.). The wall may be located on the first subassembly, and may fasten to a corresponding wall of the second subassembly in order to form an enclosure of the electronic device. When assembled together, the wall of the first subassembly may be brought into working engagement with the internal component located on the second subassembly, as for example, at the second wall of the second subassembly. While the first and second subassemblies may be physically attached, and more particularly the first and second walls fastened together, the first wall and the internal component may not be connected. In some cases, however, a non-fastening like and releasable holding coupling (one that does not use conventional fasteners such as screws) may be provided to help secure and seal the interface between the two disparate parts—component and wall. The holding coupling can be designed to provide limited holding power, for example, enough holding power to maintain the proper placement of the internal component with the opening/wall during use while still allowing a force to overcome it during disassembly of the subassemblies/walls. By way of example, magnetic couplings and the like may be used. This particular feature will be described in greater detail below.

Various problems may be encountered when the internal component(s) 16 and wall 12 are mated together at the opening 14, for example, controlling the interface or cosmetic reveal found between the mating parts. For example, as shown in FIGS. 2A-2E, the internal component 16 may be offset or displaced relative to the opening 14 in the wall 12 thus forming undesirable cracks, gaps, recesses, protrusions and bowing therebetween. By way of example, the internal component 16 may be offset in x, y and/or z directions as well as rotations about the x, y and/or z axes. Cracks, gaps, recesses, protrusions, and bowing can be undesirable because they can expose the inside of the electronic device to unwanted materials such as dust or moisture. They can also negatively alter the aesthetics (look and feel) of the electronic device in a non-trivial manner (adversely effect industrial design). In addition, they can negatively impact the EMI shielding of the electronic device.

These parts are typically manufactured using different processes representing very different tolerances. The tolerances of each may stack, thus forming a final assembly that does not meet standards. By way of example, tolerance stacking may lead to an overall thickness for each part that is too large or too small to interface properly. Tolerance stacking may also lead to adjacent segments that do not align properly with one another, e.g., sections that do not fit together or sections that create undesirable surfaces such as lips, bows, or gaps. This problem is exacerbated when the wall takes on a complex shape that spans multiple dimensions (e.g., a complex curve). Furthermore, as devices become thinner and more flexible there is a greater propensity for bowing to occur. Bowing can create stresses, which can also lead to separation between mating parts (pulling apart).

To counter the above effects, and to provide a more compliant design, the internal component 16 may be configured to be movable. The movement permits the internal component 16 to shift freely so that it is properly positioned relative to the opening 14 even when it would otherwise be misaligned because of stacking tolerances or undue forces that occur during use. By way of example, the internal component 16 may rotate, pivot, slide, translate, bend, flex, and the like. The internal component 16 may, for example, be movably coupled to, or movably restrained by, at a first mounting point to a structure that attaches directly or indirectly to the wall 12 during assembly of the electronic device.

In one embodiment, as shown in FIGS. 3, and 4A-4D, the movement may be provided using a moving mechanism 18 that is disposed between the internal component 16 and a structure 20 that directly or indirectly attaches to the wall 12 during assembly of the electronic device. By way of example, the structure may be another wall that is fastened with the wall 12 to form the enclosure of the electronic device. The structure 20 may also be a frame or internal structural element or possibly a printed circuit board of the electronic device. The movement may allow the internal component 16 the ability to shift away from an undesirable offset position so as to produce a tight fit between the internal component 16 and the wall/opening 12/14 when they are mated together, e.g., the movement substantially eliminates gaps, cracks, recesses, protrusions, and the like. By way of example, as shown in FIGS. 4A-4D, the movement may allow the internal component 16 to shift away from an offset position into mating engagement with the wall 12 at the opening 14. Chamfers 22 at the interfacing edges may be used to further aid in alignment and seating of these two parts. As should be appreciated, the movement can aid in the assembly of the electronic device by maintaining proper alignment between two disparate parts as well as aid in maintaining this relationship during use as, for example, when the electronic device is stressed. Accordingly, the opening 14 and the internal component 16, or the opening 14 and the mounting point of the moving mechanism 18 on the structure 20, may be aligned with each other under a first tolerance range. The internal component 16 and structure 20, or the internal component 16 and the mounting point of the moving mechanism 18 on the structure 20, may be aligned with each other under a second tolerance range. If the second tolerance range is smaller than the first tolerance range, then an incorrect fitting between the components may occur, as shown in FIGS. 2A-2E. Thus, the moving mechanism 18 may allow the internal component 16 to be movable within a second tolerance range which is greater than the first tolerance range, resulting with the internal component 16, opening 14, and structure 20 aligning properly.

The moving mechanism 18 may allow the internal component to move in single or multiple degrees of freedom (DOF). For example, movements in x, y, and/or z directions and/or rotations about the x, y, and z axes. The DOF may be implemented through one or more rotations, pivots, translations, flexes, and/or the like. By way of example, the internal component may be coupled to the structure via one or more pivot joints, translating joints, slider joints, pin joints, ball and socket joints, flexure joints, cushions, and the like. Moreover, the internal component may be coupled to the structure via a combination of the above, as for example, pivot/translating joint, pivot/flexure joint, pivot/ball and socket joint, translating/flexure joint, and/or the like. Combination of joints may also be used to increase the range of motion (increase the DOF). The internal component 16 may be movably restrained to the structure, for example, the internal component 16 may float in space relative to the structure 20.

The DOF of the internal component 16 generally depends on the number and type of joints used. In one embodiment, the moving mechanism 18 may be configured to allow the internal component 16 to move in one DOF (e.g., along the x axis). In another embodiment, the moving mechanism 18 may be configured to allow the internal component 16 to move in two DOF (e.g., along the y and z axis). In another embodiment, the moving mechanism 18 may be configured to allow the internal component 16 to move in three DOF (e.g., along the y and z axis and about the x axis). In another embodiment, the moving mechanism 18 may be configured to allow the internal component 16 to move in four DOF (e.g., along the x and z axis and about the x and y axis). In another embodiment, the moving mechanism 18 may be configured to allow the internal component 16 to move in five DOF (e.g., along the x, y, and z axis, and about the x and y axis). In yet another embodiment, the moving mechanism 18 may be configured to allow the internal component 16 to move in six DOF (e.g., along the x, y, and z axis, and about the x, y, and z axis). Six DOF generally prevents mating problems between these disparate parts, especially when the wall is formed in a complex shape that utilizes multiple dimensions.

In one particular embodiment, the internal component 16 may be configured to float in space while still being constrained or anchored to the structure 20. This permits the internal component 16 to shift freely so that it is properly positioned relative to the opening 14 even when it would otherwise be misaligned because of stacking tolerances and/or stresses. That is, the floating may allow the internal component 16 to move in multiple DOF relative to the structure 20 so as to provide a tight fit and a desired cosmetic reveal between the mating edges/surfaces of the internal component 16 and the wall 12 and opening 14. For example, the position of the internal component 16 adjusts to the position of the opening 14 in multiple dimensions as the internal component 16 and wall 12 may come together during assembly of the electronic device, as well as when the wall is unduly stressed during use. In some cases, this may be referred to as a gimbal.

Figure 5:
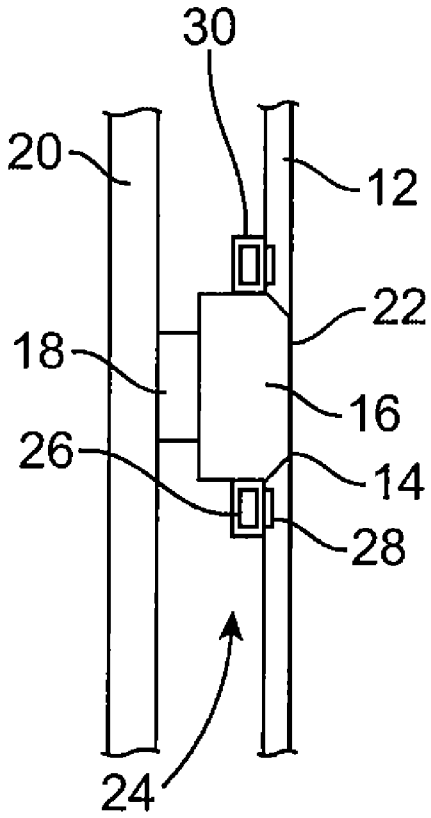
FIG. 5 is a simplified diagram of a movable internal component interfacing with a wall, in accordance with one embodiment of the present invention.

A holding or clamping mechanism 24 may be provided, as shown in FIG. 5, in order to help prevent, or limit, slop between the mated parts. The holding or clamping mechanism 24 also may help prevent, or limit, movement when the internal component 16 is engaged by an external object (after assembly of the electronic device). For example, the internal component 16 may be a connector, and the external object may be a corresponding connector. For example, the internal component 16 may be an I/O device, such as a button, and the external object may be a user. Generally speaking, the clamping mechanism 24 may be configured to help maintain a secure relationship between the internal component 16 and the wall 12. The clamping mechanism 24 may also be configured to help resist engagement forces that are applied to the internal component 16 when an external object is brought into engagement with the internal component 16. In addition, the clamping mechanism 24 may be releasable, or detachable or allow limited movement so that the interface can adjust and so that the wall 12 may be easily removed from the internal component 16 during disassembly.

The clamping mechanism 24 may generally consist of two parts; a component side clamping feature 26, and a wall side clamping feature 28. These two features 26/28 may be cooperatively positioned so that when the internal component 16 and wall 12 are mated, the clamping features 26/28 may be capable of engaging to help secure the internal component 16 to the wall 12. The clamping features 26/28 may continuously surround, or be disposed at discrete locations around, the interface. The configuration of the clamping features 26/28 may generally depend on the clamping force as well as the dimensions of the interface. At the very least, the clamping features 26/28 may include opposed features placed on opposite sides or corners (e.g., two sides, four sides, etc.). The clamping features 26/28 may be widely varied. In one example, they are magnetic couplings. Of course, this is not a limitation and other releasable couplings or non-fastener couplings may be used.

Figure 6:
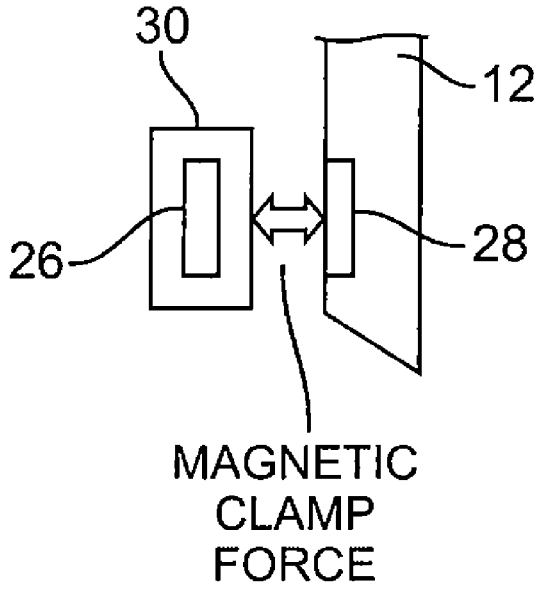
FIG. 6 shows a magnetic attraction between an internal component and a wall, in accordance with one embodiment of the present invention.

In one particular embodiment, as shown in FIG. 6, the clamping mechanism 24 may utilize magnetic attraction to hold the movable internal component 16 relative to the wall 12. The magnetic clamping mechanism 24 may generally include one or more magnetic clamping elements 26/28 for magnetically clamping the movable internal component 16 to the wall 12. In one embodiment, the magnetic clamping elements 26/28 may take the form of a magnetic attractable surface 28 and a magnet 26. The magnet 26 may for example be a permanent magnet and the magnetic attractable surface may, for example, be formed from a ferromagnetic material. In one example, the ferromagnetic material is steel. The term magnetic element, or magnetic clamping element, as used herein may also be taken to mean a magnetic attractable surface 28 or a magnet 26.

In some cases (as shown), the magnetic attractable surface 28 may be located on the inside surface of the wall 12 and the magnet 26 is fixed directly or indirectly to the internal component 16. In other cases, the magnetic attractable surface 28 may be attached to the internal component and the magnet 26 is fixed directly or indirectly to the inside surface of the wall 12. In either case, the magnet 26 and magnetic attractable surface 28 are cooperatively positioned so that when the internal component 16 is placed proximate the opening 14 in the wall 12, as for example during an assembly condition, the magnet 26 and magnetic surface 28 may be magnetically attracted (or drawn) to one another, thus clamping the movable internal component 16 to the wall 12. The internal component 16 may be pulled towards the wall 12 and seated properly against the wall 12 relative to the opening 14. As should be appreciated, this particular system allows the removable wall 12 to be easily removed and reattached, while still holding the internal component 16 to the wall 12 during use of the electronic device. Thus, the internal component 16 may be held and correctly positioned relative to the opening 14 in the wall 12, and is capable of resisting engagement forces from external devices that wish to connect to the internal component 16. Furthermore, because the internal component may be pulled to the wall 12, the wall 12 may not flex or bow as might happen with other configurations, e.g., the wall 12 may not flex because it does not experience pressure from a different kind of coupling such as a spring pushing on the wall 12.

Referring to FIGS. 5 and 6, one embodiment of a magnetic clamping mechanism will be described in greater detail. As shown, the internal component 16 may include a flange portion 30 that extends or protrudes away from the side of the internal component 16. The flange portion 30 may extend entirely around the internal component 16 or it may be located on one or more opposing sides of the internal component 16 (as shown). Each of the flanges 30 may include a magnet 26 that may be embedded within the flange (as shown) or situated on the top or bottom side of the flange 30. The magnets are magnetically attracted to the magnetic attractable surface 28 situated at the wall 12. The magnetic attractable surface 28 may be a portion of the wall 12 (if ferromagnetic) or a ferromagnetic magnetic plate (e.g., steel) that is embedded within or at an interior surface of the wall 12 (as shown). During an assembly condition, the wall 12 may be moved towards the internal component 16. Magnetic attraction may cause the internal component 16 to move and seat properly relative to the opening 14 in the wall 12. For example, magnetic attraction may provide a force that moves the internal component 16 towards the wall 12, and the movable nature of the internal component 16, in multiple dimensions, allows the internal component 16 to shift until the chamfers 22 are properly engaged. Furthermore, during normal use, the magnetic attraction is strong enough to resist external forces being applied from external devices.

As should be appreciated, the clamping nature of the securing system may help seal the interface from EMI. To further enhance the EMI shielding, a shielding member (not shown) may be disposed at the interface between the two disparate parts. Alternatively, or additionally, the internal component 16 may be configured as a shield such that when interfaced with the wall via the clamping system and/or proper alignment, the interface is effectively shielded. For example, the internal component 16 may be formed from shielding materials or include shielding layers such as coatings, plates, and the like. Similar configurations may be applied to the wall and the opening where the internal component 16 interfaces.

Figure 7:
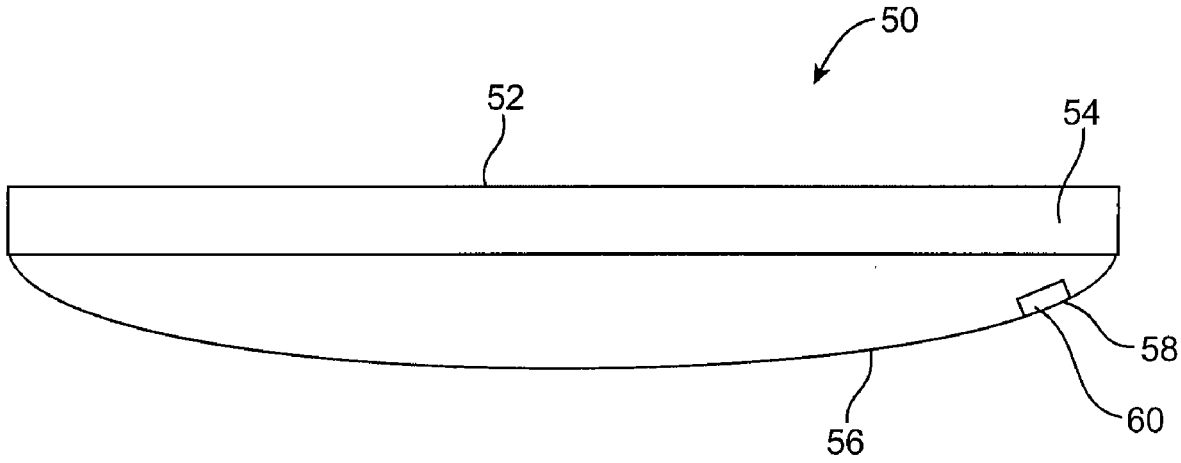
FIG. 7 is a simplified diagram of at least a portion of an electronic device, in accordance with one embodiment of the present invention.

FIG. 7 is a simplified diagram of at least a portion of an electronic device 50, in accordance with one embodiment of the present invention. The electronic device 50 may, for example, be a portable device such as a laptop, tablet computer, cell phone, media player, or the like. The electronic device 50 may generally include an enclosure 52 configured to enclose various operational and structural components of the electronic device 50. The operational components may, for example, be integrated circuit chips and other circuitry that provide computing operations for the electronic device 50. By way of example, the integrated circuit chips and other circuitry may include a microprocessor, Read-Only Memory (ROM), Random-Access Memory (RAM), storage devices, a battery, and various input/output support devices. The enclosure 52 may also support various operational components at its surfaces. For example, the enclosure may support displays, keyboards, keypads, touch pads, buttons, and the like, at an exterior surface for interaction with a user.

The enclosure 52 may generally include a contour which defines the shape or form of the electronic device. The contour may be rectilinear, curvilinear, or both (as shown). The form and shape of the enclosure typically varies according to the specific needs and/or desired industrial design of the electronic device 50. The enclosure 52 may include a first housing portion 54 and a second housing portion 56 that form a peripheral region of the electronic device 50 and that serve to support the various components of the electronic device 50 in their assembled state.

In the illustrated embodiment, the first housing portion 54 may be substantially rectilinear, and the second housing portion 56 may be substantially curvilinear. The second housing portion 56 may, for example, contain a curvature that can be defined in three dimensions (x, y, and z). Various fastening mechanisms such as screws, snaps, etc. may be used to attach the two housing components together. In some instances, integrated circuit chips and other circuitry enclosed therein, may generate EMI. Therefore, the enclosure 52, and more particularly the first and second housing portions 54 and 56, may also be configured to contain the EMI.

The enclosure 52 may include various openings that provide access to the operational components of the electronic device. In the illustrated embodiment, the second housing portion 56 may include an opening 58 at a curved portion of the second housing portion 56. In one embodiment, the opening 58 may provide access to a connector assembly 60 which is disposed internally within the enclosure 52. In some cases, the connector assembly 60 may form an entire connector 62 of the electronic device 50, e.g., disposed completely through the opening. In other cases, the connector assembly 60 cooperates with the opening/second housing portion 56/58 to form a connector 62 of the electronic device 50, e.g., the opening may provide a void for receiving and aligning a corresponding external connector. The connector 62 may be a power and/or data connector such as DC, AC, USB, Firewire, AV jacks, card slots, network, display, or the like. The connector 62 may, for example, correspond to the internal component described in FIGS. 1-6.

In one particular embodiment, the connector 62 may be a power connector such as the MagSafe™ power connector manufactured by Apple Inc. of Cupertino, Calif. The MagSafe™ power connector utilizes a magnetic attraction to help retain a corresponding connector thereto. By way of example, some aspects of a magnetically attracted connector may be found in U.S. patent application Ser. No. 11/235,875, patented as U.S. Pat. No. 7,311,526, and Ser. No. 11/235,873, patented as U.S. Pat. No. 7,351,066, which are herein incorporated by reference. It should be noted that the magnetic force between the connector assembly 60 and the housing portion 56 may be configured to withstand the magnetic force between the connector assembly and the corresponding magnetically attracted connector that couples thereto.

The connector assembly 60 may be supported internally, either directly or indirectly, by the first housing portion 54 of the enclosure 52. When the two housing portions 54/56 are assembled together, the connector assembly 60 may be configured to align itself with the opening 58 of the second housing portion 56. In addition, the connector assembly 60 may be configured to be movable and/or releasably secured, rather than fastened or physically attached, relative to the second housing portion 56 proximate the opening 58. By being movable, the connector assembly 60 may better align with the opening 58 during assembly of the first and second housing portions 54 and 56. In addition, the connector assembly 60 may provide some relief if the enclosure 52 is stressed as, for example, when it encounters a flexed state. By being releasable, the second housing portion 56 may be easily removed from first housing portion 54 during a disassembly condition. Although releasable, the connector assembly 60 can be secured with ample force to resist external forces applied from an external connector.

Figure 8A:
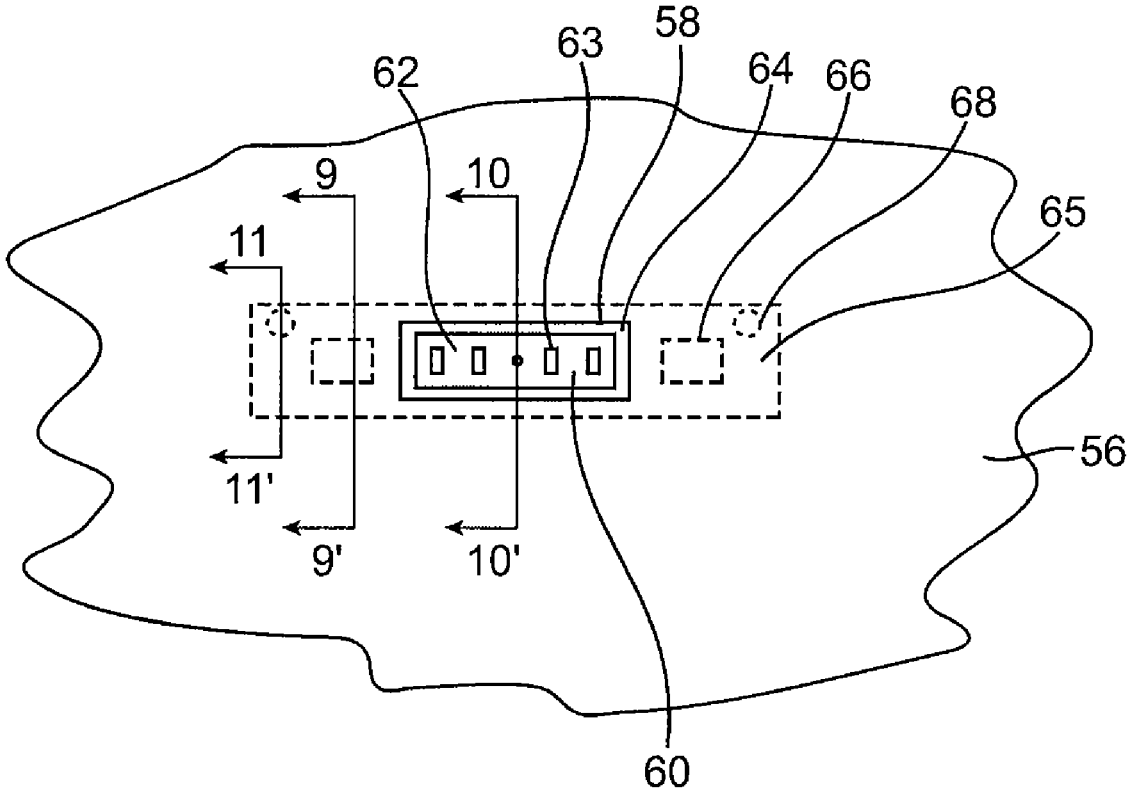
FIG. 8A is a broken away top view of a connector, in accordance with one embodiment of the present invention.
Figure 8B:
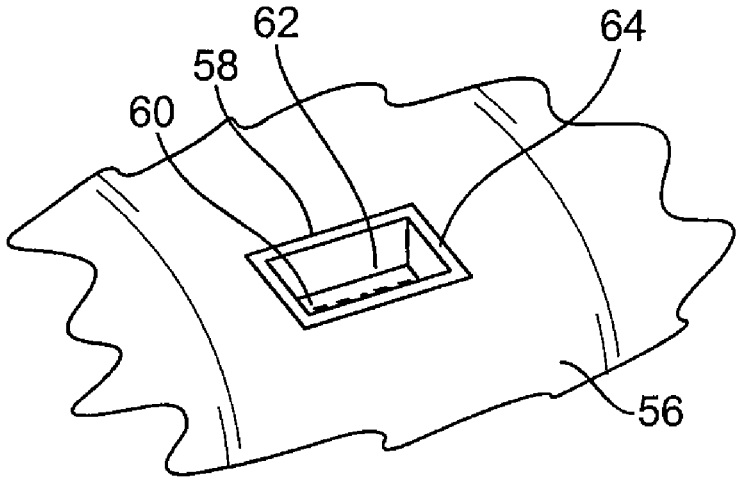
FIG. 8B is a broken away perspective view of a connector, in accordance with one embodiment of the present invention.

The connector 62 is shown in greater detail in FIGS. 8A and 8B, in accordance with one embodiment of the present invention. FIG. 8A is a broken-away top view of the connector 62, and FIG. 8B is a broken-away perspective view of the connector 62. In this particular embodiment, the connector 62 may be formed by the connector assembly 60 and a connector bezel 64 of the second housing component 56. The connector assembly 60 may carry one or more contacts or electrical pins 63, and may form at least a portion of the base of the connector 62. The bezel portion 64 may help form a void, and may help define at least a portion of the surrounding side walls of the connector 62, for example, to create a socket. The connector bezel 64 may be an integral portion of the second housing component 56, or the connector bezel 64 may be a separate insert that fits within the opening 58, and attaches to the second housing wall 56, as shown. By way of example, the insert may be glued or otherwise attached.

In the illustrated embodiment, the connector assembly 60 may be movable relative to the connector bezel 64, and the connector bezel 64 may be fixed to the inner surface of the second housing portion 56. Both the connector assembly 60, and the connector bezel 64, may include flange portions 65 that extend laterally away from the opening 58, along the elongated axis of the opening 58 as shown by the broken lines. The flange portions 65 may be in an opposed relationship on both sides of the opening 58, as shown.

Furthermore, each of the flange portions 65 may include cooperatively positioned magnetic elements 66 that provide an attraction force therebetween. The magnetic elements can help secure and/or seal the interface between the connector assembly 60 and the connector bezel 64. The connector assembly 60 may also be movably restrained, either directly or indirectly, to the first housing portion 54 via one or more moving elements 68. The moving elements 68 may allow the connector base 62 to shift relative to the connector bezel 64, in order to allow proper mating engagement therebetween, as the attraction forces of the magnetic elements 66 pull the connector base 62 towards the connector bezel 64. In one embodiment, the coupling system may include multiple moving elements 68 that work together to provide a limited amount of movement. For example, the coupling system may include a moving element 68 on each flange portion 65, as shown. In some cases the moving elements may be mirrored and similarly located, while in other cases they are located at different locations on their respective flange portions 65.

Figure 9:
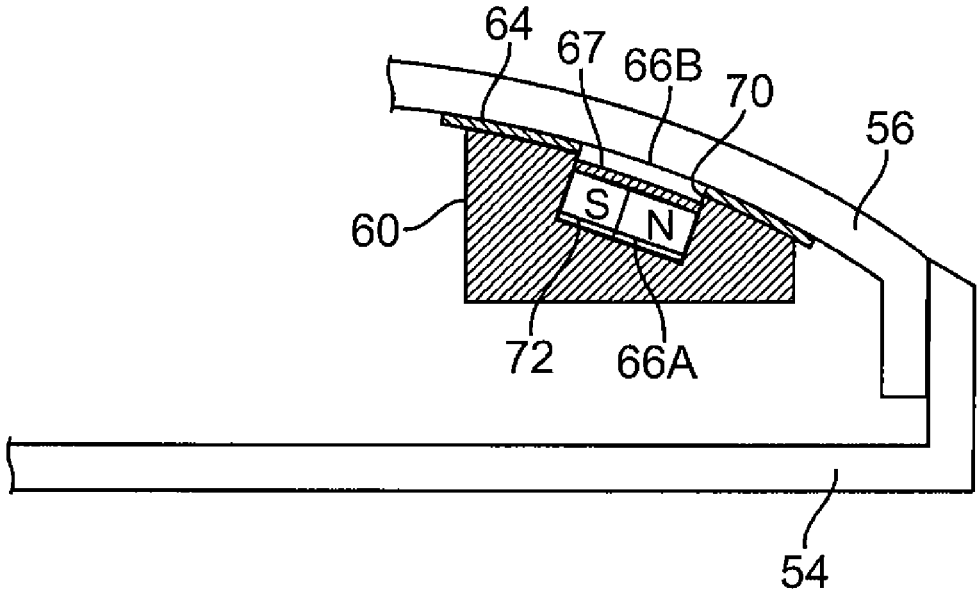
FIG. 9 is a side cross-sectional view taken along line 9-9' in FIG. 8A, in accordance with one embodiment of the present invention.

FIG. 9 is a side cross-sectional view taken along line 9-9' in FIG. 8A, in accordance with one embodiment of the present invention. As shown in one example, the connector bezel 64 may be attached to the inner surface of the second housing portion 56. This may, for example, be accomplished with a glue or epoxy. The connector bezel 64 may include a magnetic attractable plate 66B that forms part of the magnetic element 66. The magnetic attractable plate 66B may, for example, reside in a recessed portion 70 of the connector bezel 64. Although not shown, in some cases the magnetic attractable plate 66B may be covered with a wear pad. The magnetic attractable plate may be formed from a ferromagnetic material. In one example, the plate is formed from steel.

The connector assembly 60 may include therein a magnet 66A that forms part of the magnetic element 66. The magnet 66A may, for example, reside in a recessed portion 72 of the connector assembly 60. The magnet 66A may be formed by one or more magnet components, for example, the magnetic components may include side-by-side magnets that work together to form the desired magnetic field. In some cases, the magnet 66A may be covered with a wear pad 67. The wear pads 67 may be configured to resist wear and may also provide a dampening effect when the connector assembly 60 engages the connector bezel 64. The magnet may, for example, be a permanent magnet. As should be appreciated, the magnets 66A and magnetic attractable plates 66B are cooperatively positioned, such that a magnetic attraction occurs therebetween when the base of the connector assembly 60 comes in close proximity to the connector bezel 64. The magnetic attraction may be configured to hold the connector assembly 60 relative to the connector bezel 64. The magnetic attraction force may also help seal the interface between the two parts.

Figure 10:
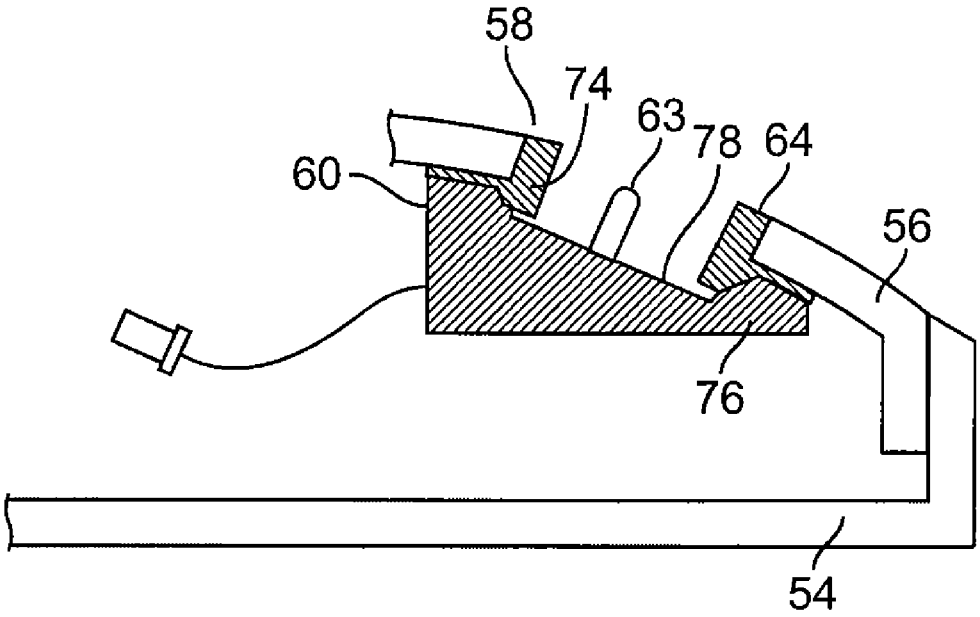
FIG. 10 is a side cross-sectional view taken along line 10-10' in FIG. 8A, in accordance with one embodiment of the present invention.

FIG. 10 is a side cross-sectional view taken along line 10-10' in FIG. 8A, in accordance with one embodiment of the present invention. As shown, the connector bezel 64 may include an outer chamfer 74 that is disposed about the periphery of the opening 58. The outer chamfer 74 may mate with an inner chamfer 76 formed within a recessed portion 78 in the base of the connector assembly 60. The chamfers 74/76 help guide the two parts into proper alignment as the two parts engage one another. The base of the connector assembly may further include the contacts or electrical pins 63 of the connector 62, which may be situated at the base or on a protruding member extending therefrom, as shown.

Figure 11A:
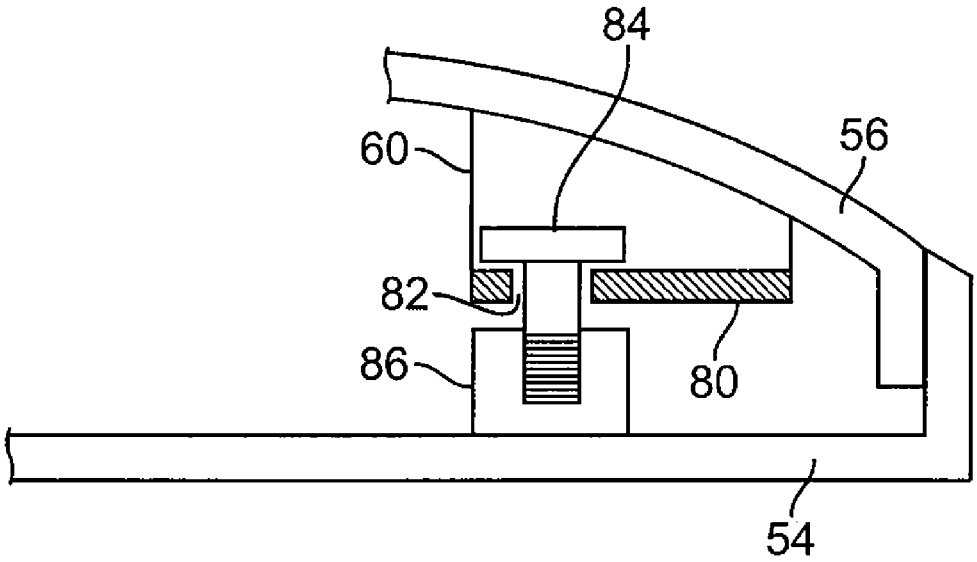
FIG. 11A is a side cross-sectional view taken along line 11-11' in FIG. 8A, in accordance with one embodiment of the present invention.

FIG. 11A is a side cross-sectional view taken along line 11-11' in FIG. 8A, in accordance with one embodiment of the present invention. As shown, the flange portion 65 of the connector base 62 may include wings 80 that support the moving elements 68 of the connector base 62. The wings 80 on opposed flanges may be located and configured similarly, or differently, depending on the needs of the connector assembly 60. The moving elements 68 may be created with an opening 82 in the wing 80, and shoulder bolts 84 that mount to a post 86 of the first housing portion 54 through the opening 82. The height of the pin portion of the shoulder bolt and the diameter of the opening may be dimensioned to allow a limited amount of movement along x, y, and z axes as well as rotations about the x, y, and z axes. The amount of movement may be designed to allow shifting of the connector assembly 60 to maintain the proper alignment between the connector assembly 60 and the connector bezel 64, when the two are engaged during an assembly condition. Thus, the diameter of the opening 82 may be oversized compared to the pin portion of the shoulder bolt, and the height of the pin portion may be oversized compared to the height of the wing. Thus, enabling limited shifts in the x, y, and z directions and limited tilts about the x, y, and z axes (6 DOF). The connector base 62 (not shown in this view) may gimbal while being physically constrained to the first housing portion 54. The diameter and heights may be adjusted to the desired DOF.

Figure 11B:
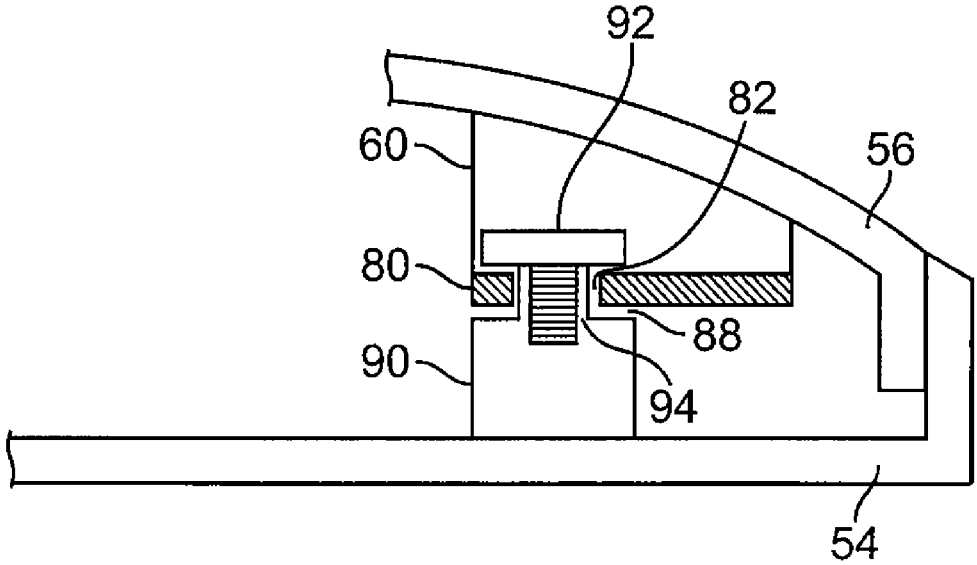
FIG. 11B is a side cross-sectional view taken along line 11-11' in FIG. 8A, in accordance with an alternate embodiment of the present invention.

FIG. 11B is a side cross-sectional view taken along line 11-11' in FIG. 8A, in accordance with an alternate embodiment of the present invention. As shown, the flange portion 65 of the connector base 62 may include wings 80, which may support the moving elements 68 of the connector base 62. The wings 80 on opposed flanges may be located and configured similarly or differently depending on the needs of the connector assembly 60. The moving elements 68 may be created with an opening 82 in the wing 80, which loosely fits within a channel 88, which is formed by a stepped post 90 of the first housing portion 54 and a screw 92. The height of the pin portion 94, of the stepped post 90, and the diameter of the opening may be dimensioned to allow a limited amount of movement along x, y, and z axes as well as rotations about the x, y, and z axes. The amount of movement may be designed to allow enough shifting of the connector base in order to maintain the proper alignment between the connector base and the connector bezel when the two are engaged during an assembly condition. Thus, the diameter of the opening may be oversized compared to the pin portion 94 of the stepped post 90, and the height of the pin portion 94 may be oversized compared to the height of the wing. Thus, enabling limited shifts in the x, y, and z directions and limited tilts about the x, y, and z axes (6 DOF). The connector base 62 (not shown in this view) may gimbal while being physically constrained to the first housing portion 54. Of course, the diameter and heights may be adjusted to the desired DOF.

It should be noted that the principles described herein are not limited to connectors and may be applied to other components that may facilitate communication such as I/O devices. Some examples of I/O devices may include: buttons, touch pads, trackballs, displays, keys, infrared sensors, LED indicators and other I/O devices as disclosed herein.

Figure 12:
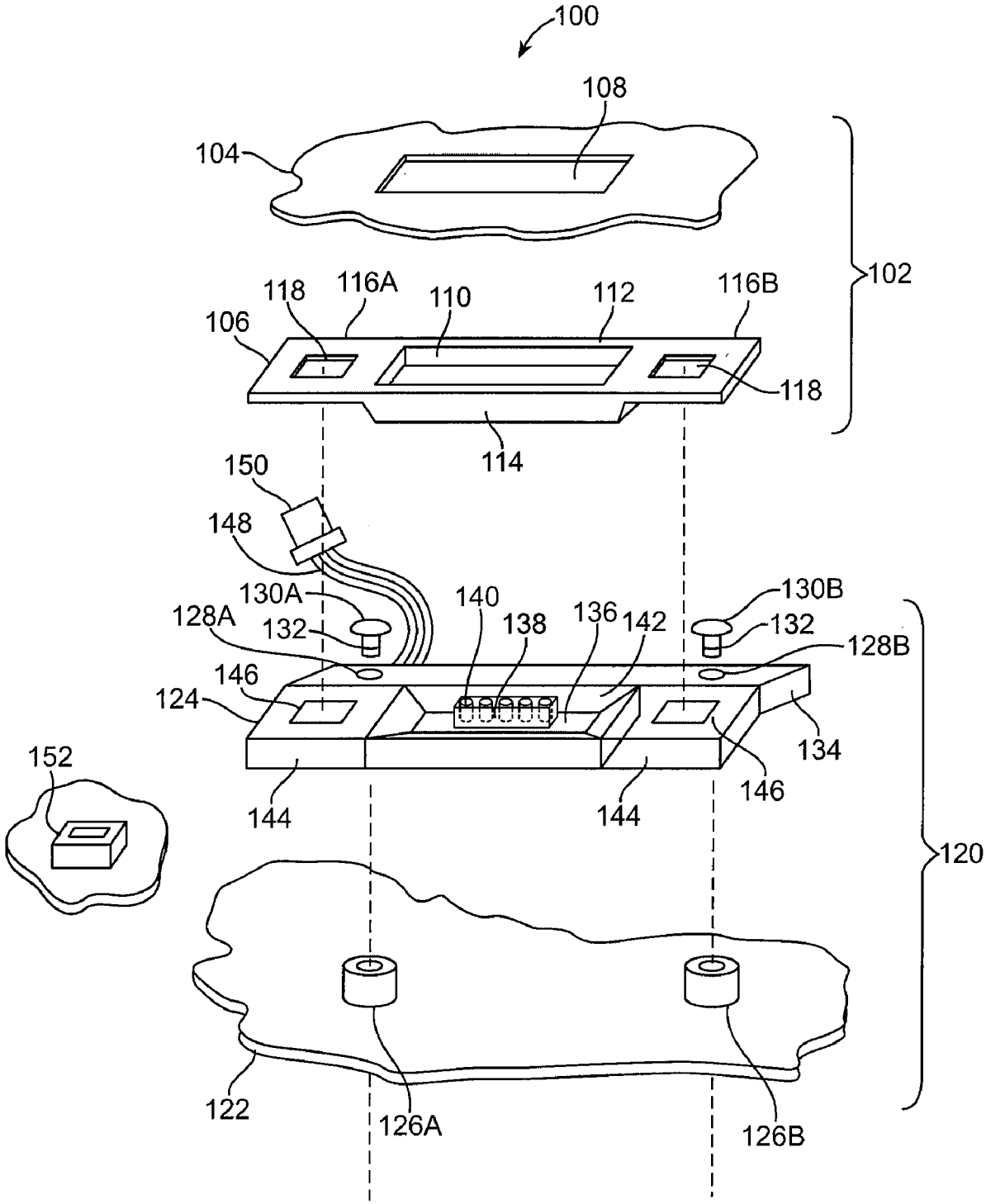
FIG. 12 is an exploded perspective view of a connector arrangement, in accordance with one embodiment of the present invention.

FIG. 12 is an exploded perspective view of a connector arrangement 100, in accordance with one embodiment of the present invention. The connector arrangement 100 may, for example, correspond to the connector of FIGS. 7-11, or the internal component described in FIGS. 1-6, or a combination thereof. The connector arrangement 100 may include a first housing portion 102. The first housing portion 102 may include an outer housing wall 104 of an electronic device and an insert 106 that is fixed to the inner side of the outer housing wall 104. The outer housing wall 104 may include an opening 108, and the insert 106 includes an opening 110 which aligns with the opening 108. The insert 106 may include a lip 112 that surrounds the periphery of the opening 110, and is dimensioned to fit within the opening 108 in the outer housing wall 104, e.g., the outer periphery of the lip 112 coincides with the inner periphery of the opening 108. When fitted therein, the top surface of the lip 112 may be designed to be flush with the outer surface of the outer housing wall 104. The insert 106 also may include chamfered portion 114 that surrounds the periphery of the opening 110, and flange portions 116A and 116B that extend laterally away from the opening 110. Each of the flange portions 116A and 116B may include a magnetic attractable plate 118 therein. The magnetic attractable plate 118 may, for example, be formed from a ferromagnetic material. In one example, the plates are formed from steel.

The connector arrangement 100 also may include a second housing portion 120. The second housing portion 120 may include a second outer housing wall 122 of the electronic device and a movable connector base 124. The second outer housing wall 122 may include a pair of spaced apart posts 126A and 126B. The posts 126A and 126B may be attached to, or may be integral with, the second outer housing portion 120. The posts 126A and 126B may be situated along the same axis, or be offset from one another. Furthermore, the posts 126A and 126B may be the same height, or a different height, depending on the needs of the system.

The movable connector base 124 may include a pair of through holes 128A and 128B that are positioned relative to, and generally align with, the pair of posts 126A and 126B. The movable connector base 124 may be movably restrained from the second outer housing portion 120 via a pair of shoulder bolts 130A and 130B, which may pass through the holes 128A and 128B, and which may threadably attach to the posts 126A and 126B. The height of the pin portion 132, of the shoulder bolts 130A and 130B, may be greater than the depth of the resting plate 134, within which the holes 128A and 128B are positioned. This arrangement enables the movable connector base limited movement in the x, y, and z directions as well as rotations about the x, y, and z axes. The amount of movement is greater than any stack up that may be found between the first outer housing portion 102 and the second outer housing portion 120. The movable connector base 124 also may include a connector region 136 that contains a protruding member 138 having one or more electrical contacts 140. In the illustrated embodiment, there are 5 contacts situated in a line. The pin layout may correspond to the pin layout of the MagSafe™ Power connector manufactured by Apple Inc. of Cupertino, Calif. Although the resting plate is shown as a planar piece, it should be appreciated that the resting plate may come in varying lengths, widths, and heights. The resting plate may be stepped in the Z axis if the posts are configured at different heights, or offset in the X axis if the posts are offset in Y axis.

The connector region 136 may be situated in a recess that is surrounded at its periphery by a chamfered portion 142. Extending laterally on the sides of the connector region 136 are a pair of flange portions 144, in one example. The flange portions 144 may contain magnet elements 146. Although shown as mirrored flanges, it should be appreciated that the flanges may be provided in different lengths, widths, and heights depending on the needs of the connector arrangement.

The magnetic elements 146 may include one or more magnets, which may be disposed within a void in the flange portions 144, including a wear pad disposed over the one or more magnets. In one embodiment, each void may contain side-by-side north-oriented and south-oriented magnets (shown by broken lines), in order to maximize the magnetic field. The movable connector base 124 also may include a flex circuit or wire set 148 extending therefrom. The flex circuit or wire set 148 may include a connector 150 on one end that mates with a corresponding connector 152 within the electronic device. The connector 152 may, for example, be attached to a printed circuit board and coupled to a power management system of the electronic device. The flex circuit or wire set 148 may be attached directly to the contacts within the connector base, or to a PCB that is mounted on the side of the connector base and which connects to the contacts within the connector base. The length of the flex circuit or wire set may be dimensioned to allow movement of the connector base (e.g., to include some slack).

During assembly of the electronic device, the first outer housing portion 102 and the second outer housing portion 120 may be brought together for attachment. As they approach one another, the movable connector base 124 shifts and aligns with insert 106 such that the chamfers 114/142 engage and mate (the edge of the chamfered portion mates with the coinciding chamfered portion at the edges). In addition, the magnetic force supplied by the magnets may pull and hold the movable connector base 124 next to the insert 106, thus, securing the connector base 124 relative to the insert 106. More particularly, the magnets may be attracted to the magnetic plates, thus, moving the connector base 124 towards the insert 106. It should be pointed out that there may be a net neutral force being felt by the first outer housing portion 102 by the connector base 124, which results the absence of pulling or pushing on the first outer housing portion 102. Furthermore, during assembly, the movable connector base 124 and insert 106 may blindly mate together, an occurrence which may be hidden from the assembler. Thus, the mating process requires no extra steps or processing other than aligning and mating the first outer housing portion 102 and the second outer housing portion 120. During disassembly of the electronic device, the first outer housing portion 102 and the second outer housing portion 120 are peeled away from one another. When the peeling force is greater than the magnetic force, the wall/insert 104/106 disengages from the connector base 124.

Figure 13A:
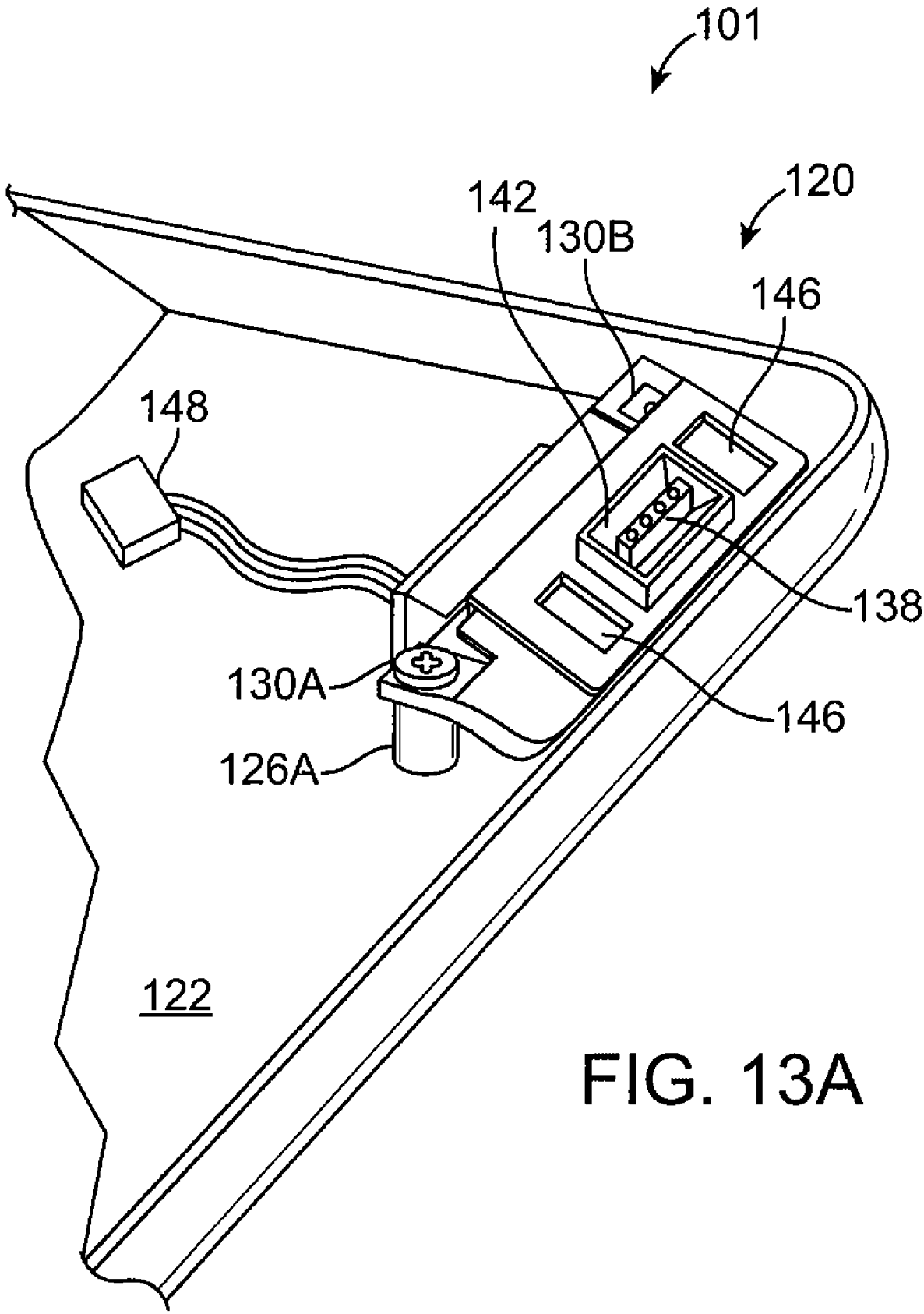
FIG. 13A is a broken away front perspective view of a connector arrangement, in accordance with one embodiment of the present invention.
Figure 13B:
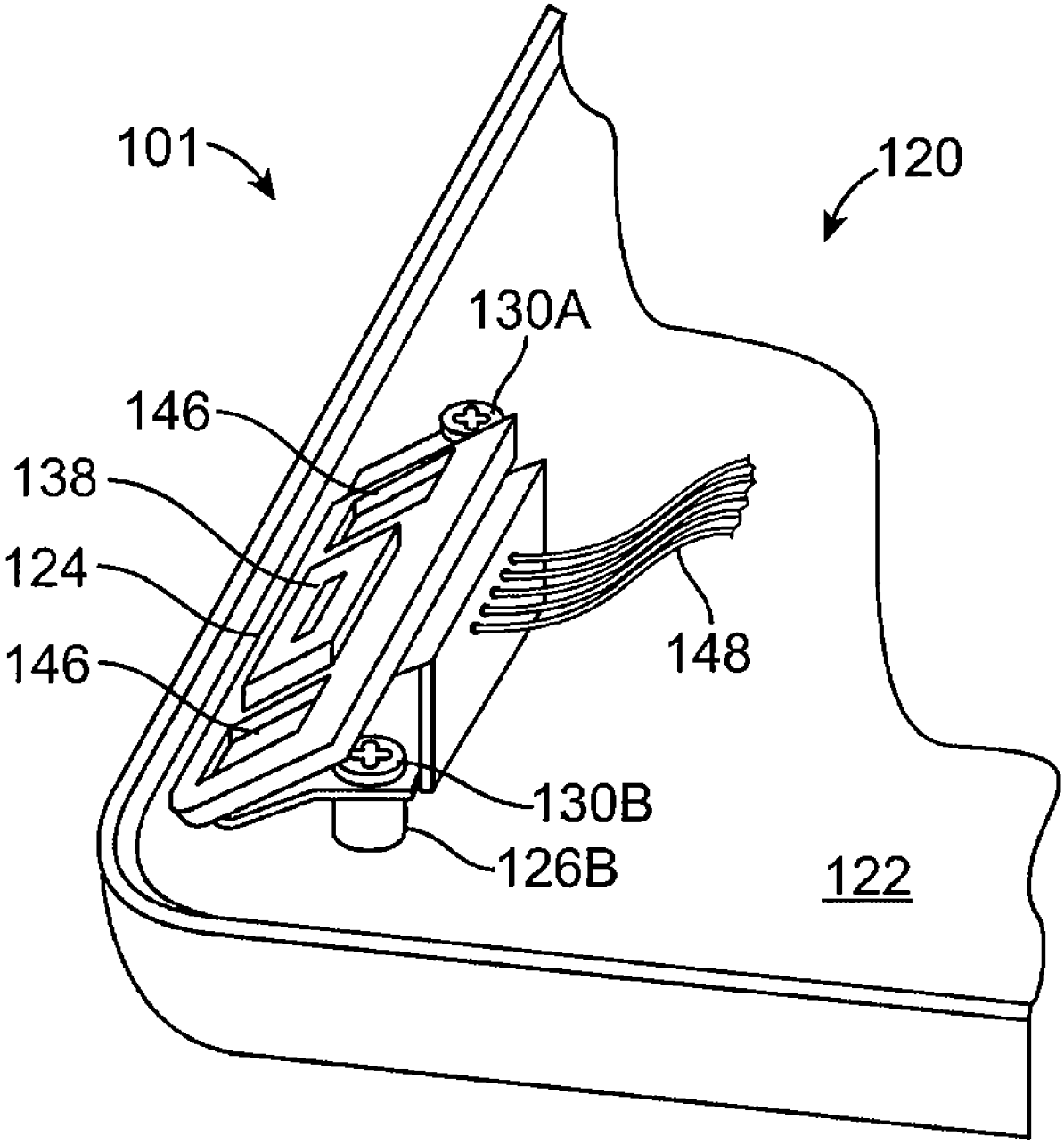
FIG. 13B is a broken away rear perspective view of a connector arrangement, in accordance with one embodiment of the present invention.

FIGS. 13A and 13B show perspective views of a connector arrangement 101, in accordance with one embodiment of the present invention. The connector arrangement 101 is similar to the connector arrangement 100 shown in FIG. 12. In this embodiment movable connector base 124, is disposed at an angle as shown. Thus, the connector arrangement 101 may be used on an irregular surface, such as a complex curved surface. In this embodiment, the posts 126 are offset and positioned at different heights, and therefore the bolts 130 are positioned at different portions of the base member 124. The base portion can be formed from multiple layers (as shown). It should be noted that the0 movable connector base 124 and posts 126 are set at an angle from each other.

Figure 13C:
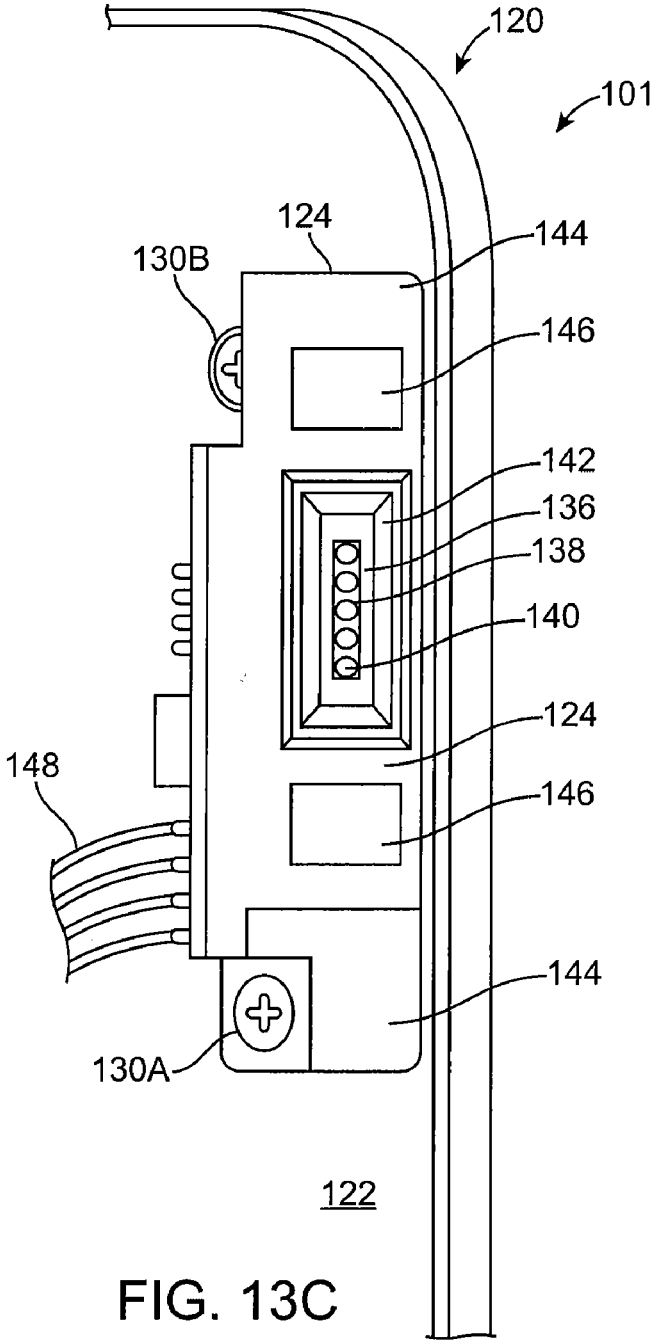
FIG. 13C is a top interior view of a connector arrangement (unassembled), in accordance with one embodiment of the present invention.
Figure 13D:
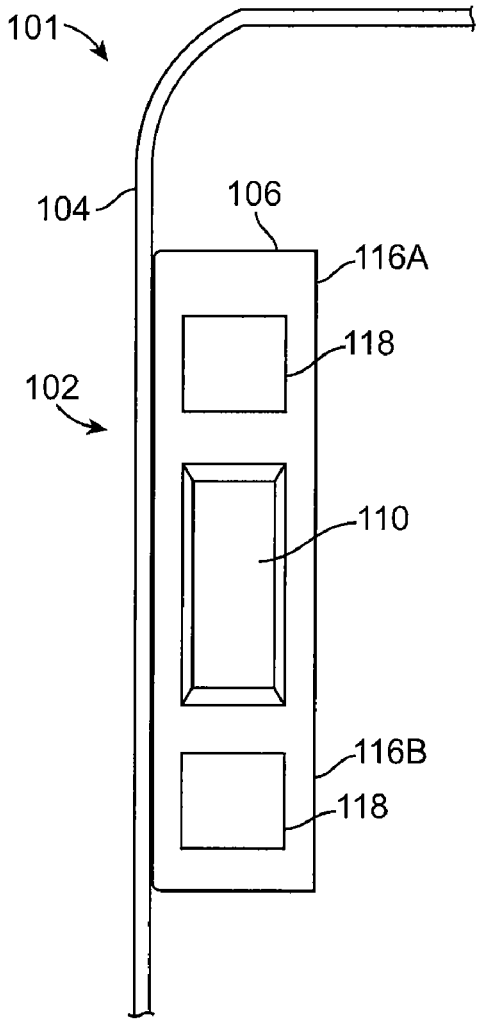
FIG. 13D is a top interior view of a connector arrangement (unassembled), in accordance with one embodiment of the present invention.

FIGS. 13C and 13D show further perspective views of the connector arrangement 101, in accordance with one embodiment of the present invention. The view of FIG. 13C may be taken normal to the main surface of the movable connector base 124. Thus, the curvature of second housing portion 120 can be seen on the right side. Similarly, the view of FIG. 13B may be taken normal to the main surface of insert 106. From these views, it is shown that connector arrangement 101 is particularly advantageous because it may be configured for a complex or curved surface.

Figure 13E:
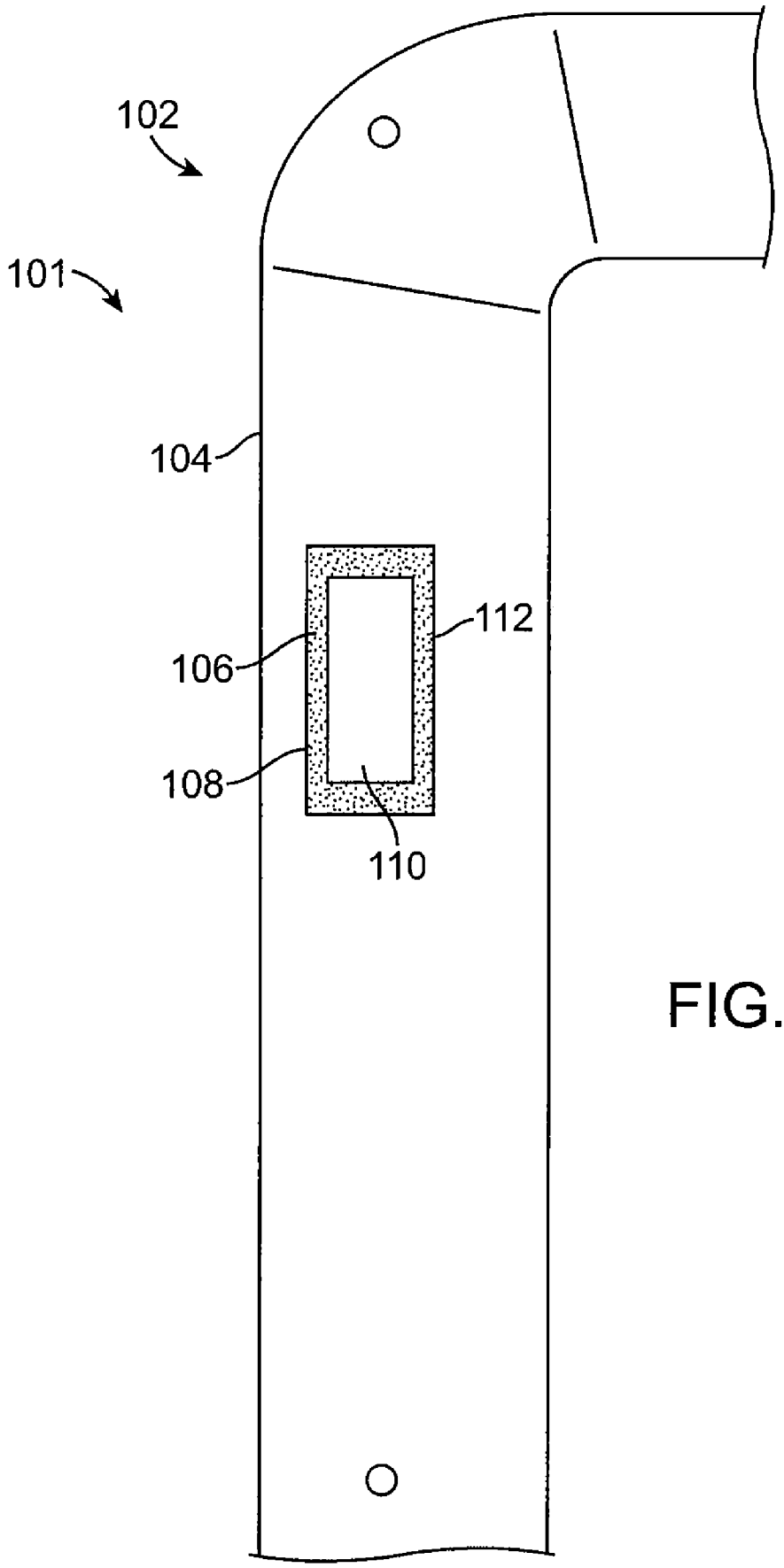
FIG. 13E is a top exterior view of a connector arrangement (unassembled), in accordance with one embodiment of the present invention.

Furthermore, FIG. 13E shows the walls of the housing components in more detail, in accordance with one embodiment of the present invention. For example, the first housing component may include a complex curvature where the connector is located, e.g., the insert may be attached along a curved portion of the first housing component. In addition, still referring to FIG. 13E, the connector may be located between spaced-apart screws that attach the first and second housing components together. The magnetic attraction helps hold the seam between these spaced-apart fasteners. The magnetic system may allow the screws to be spaced apart further, thereby reducing the number of screws needed and thus saving weight and improving its cosmetic appearance (both from reducing screws and maintaining the seam).

It should be noted that the invention is not limited to connectors and may extend to other devices associated with an electronic device. For example, the moving/magnetic clamping system may also be applied to other accessible internal components that need to mate with a housing wall. For example, the techniques may be applied to touch pads, buttons, displays, keyboards, etc. In each of these cases, the accessible device may be movably connected to a first subassembly, and magnetically secured to a second subassembly that attaches to the first subassembly.

Furthermore, although the invention has been primarily directed at internal components such as connectors, and I/O devices, the principles of the invention may also be applied to other areas of the electronic device. In general, the movable magnetic securing system may be used to help clamp interfaces between at least two disparate parts, and this includes the seams and contact points. For example, a movable magnetic system may also be used to help secure seams between interfacing housing portions as well as to perform EMI shielding along the seam, which can be done along a length or at discrete points or regions.

Figure 14:
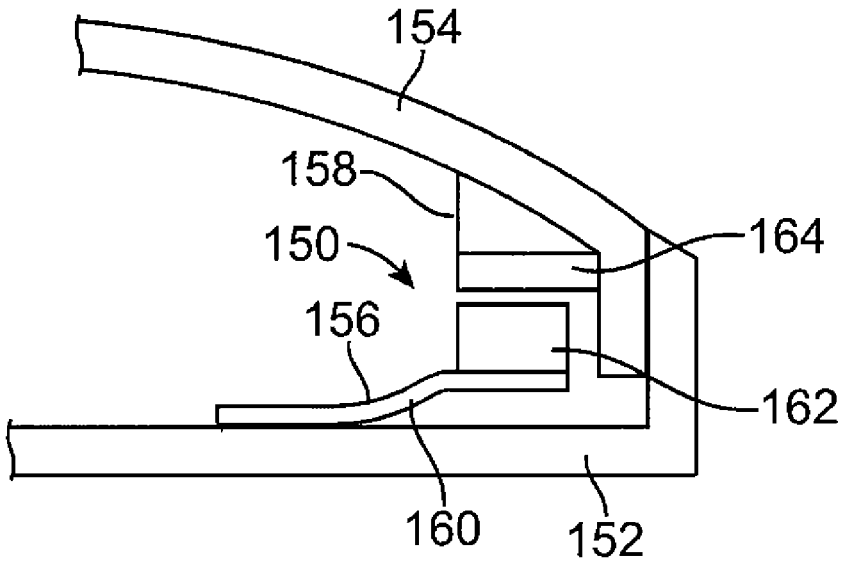
FIG. 14 is a side elevation view, in cross-section, of a magnetic securing system, in accordance with one embodiment of the present invention.

FIG. 14 is a side elevation view, in cross-section, of a magnetic securing system 150, in accordance with one embodiment of the present invention. In this embodiment, the magnetic securing system 150 may be used to help seal and hold a first housing component 152 to a second housing component 154. By way of example, the first and second housing components 152/154 may be a top and bottom case of an enclosure of an electronic device. As shown, the magnetic securing system 150 may consist of a first coupling feature 156 that is attached to the first housing component 152, and a second coupling feature 158 that is attached to the second housing component 154. The first coupling feature 156 may include a flexure 160 that is fixed to the first housing component 152. The flexure 160 supports a magnetic member 162, such as a magnet or ferromagnetic plate, that is magnetically attracted to a second magnetic member 164, that is fixed or integrally part of the second housing component 154. The flexure 160 may be tuned as needed to create the appropriate biasing force. When the two housing components 152 and 154 are coupled together, the magnetic securing system 150 provides a magnetic drawing action between the two magnetic features 156/158, which helps hold and seal the two housing components together. The magnetic securing system 150 may be implemented at discrete points, as for example, between screws with large spacing therebetween, or along a continuous length, e.g., covering a major portion of an interface.

Figure 15:
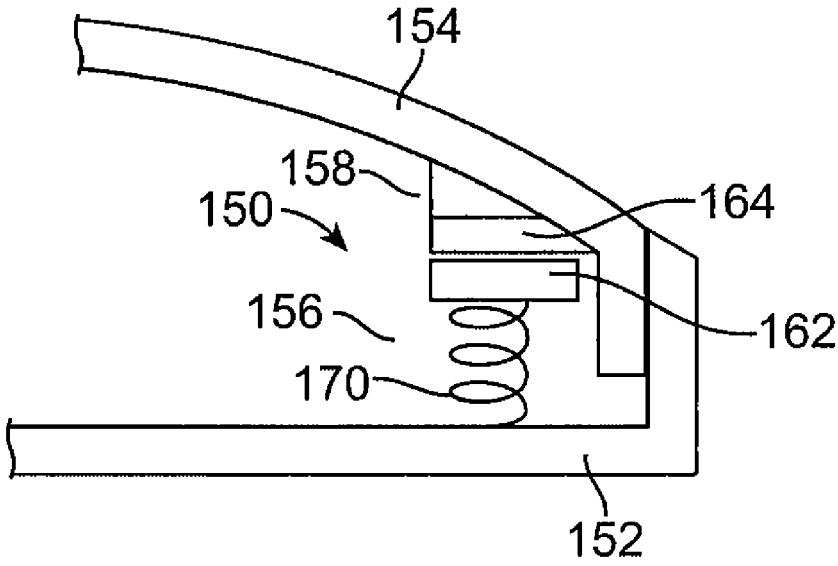
FIG. 15 is a side elevation view, in cross-section, of a magnetic securing system, in accordance with one embodiment of the present invention.

FIG. 15 is a side elevation view, in cross section, of a magnetic securing system, in accordance with another embodiment of the present invention. This embodiment is similar to that of FIG. 13, except that a coil spring 170 may be used instead of a flexure 160. It should be noted that compliant members such as foams also may be used in place of, or in addition to, flexures and/or springs. Furthermore, they may include an EMI shielding component for electrically sealing an interface.

Figure 16:
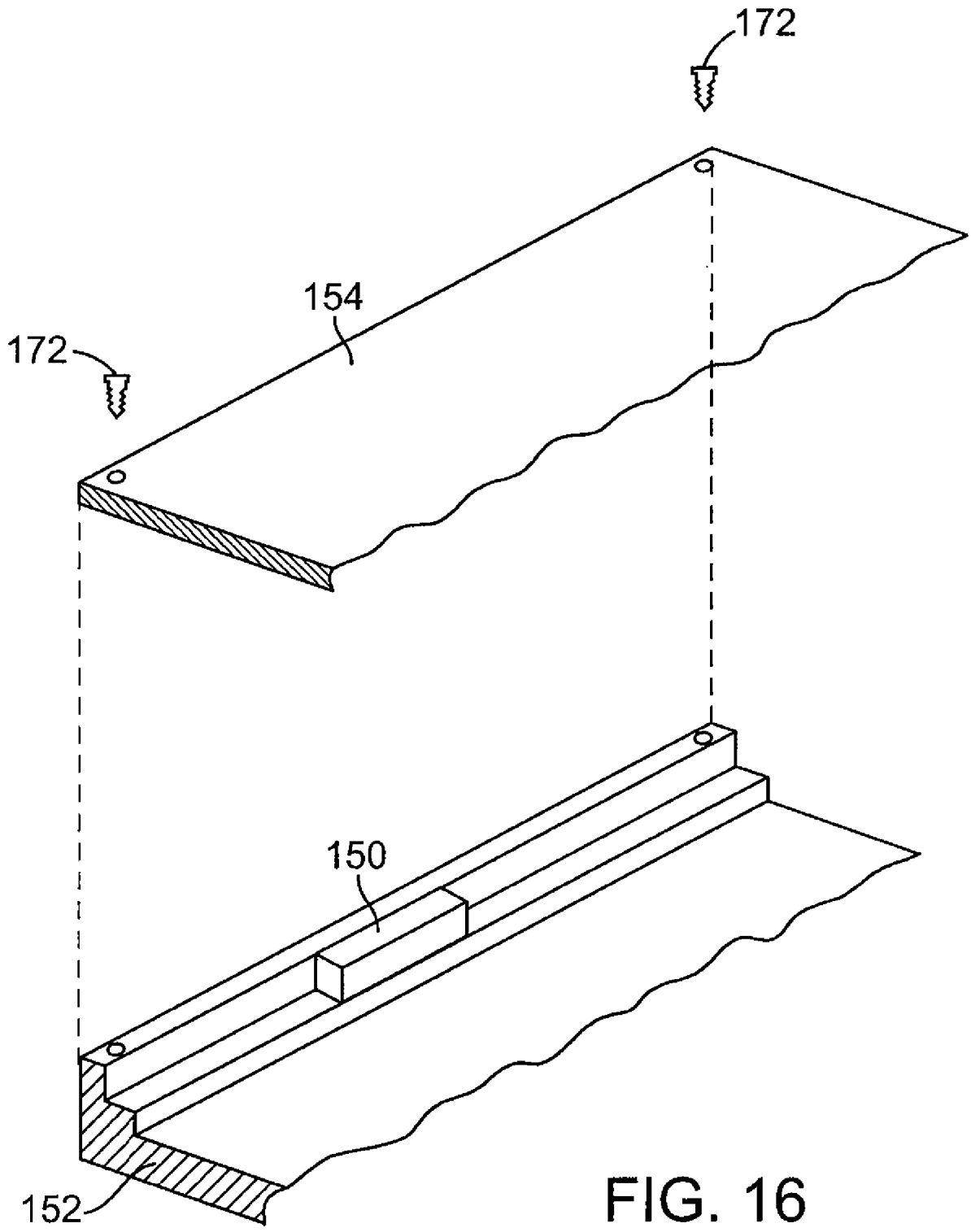
FIG. 16 is a broken away perspective view of a magnetic securing system that is used as a stitch point between two fasteners, in accordance with one embodiment of the present invention.

FIG. 16 is a broken away perspective view of a magnetic securing system 150 that is used as a stitch point between two fasteners 172, such as screws, in accordance with one embodiment of the present invention. This arrangement generally allows the screws to be placed at a greater distance from one another.

Figure 17A:
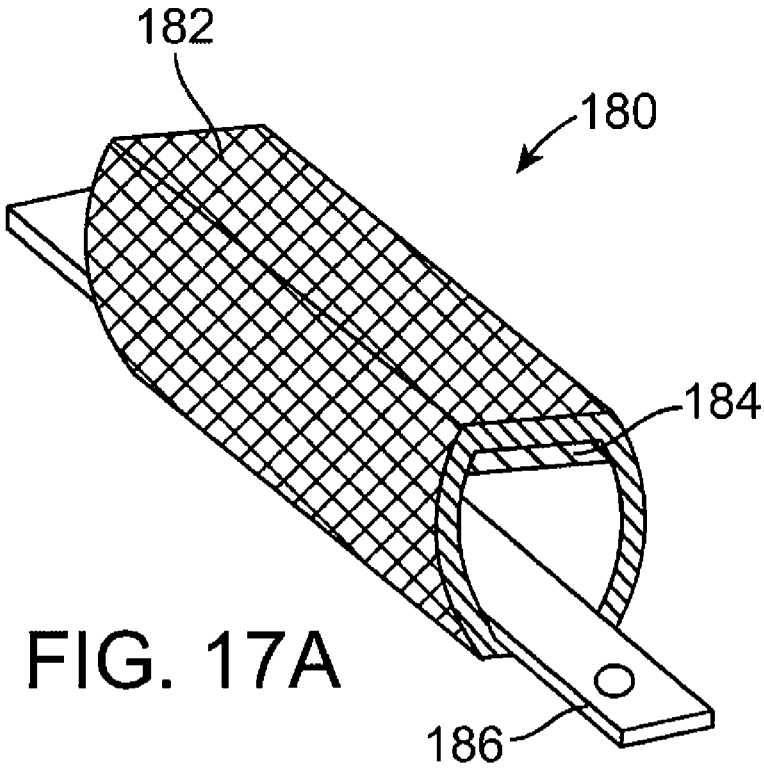
FIG. 17A is a perspective view of one side of a magnetic securing system, in accordance with one embodiment of the present invention.
Figure 17B:
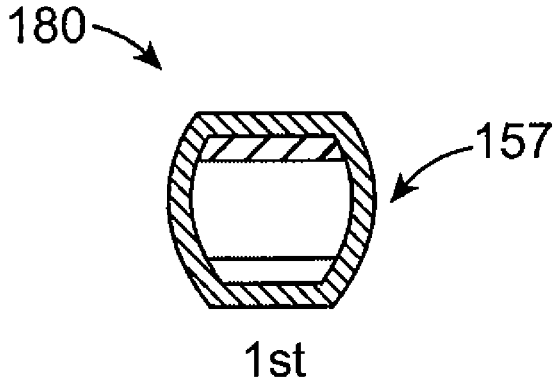
FIGS. 17B and 17C are side views of a magnetic securing system, in accordance with one embodiment of the present invention.
Figure 17C:
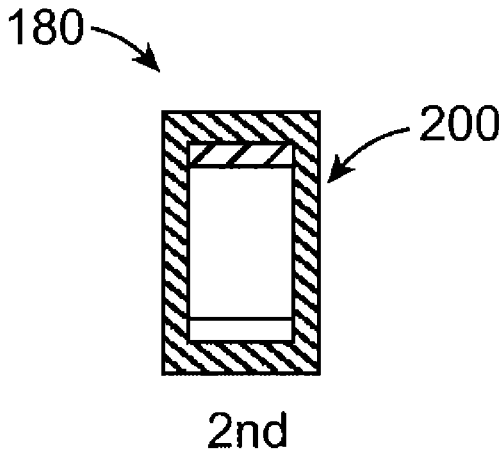

FIG. 17A is a perspective view of one side of a magnetic securing system 180, in accordance with one embodiment of the present invention. The magnetic securing system 180 can be used to help secure an interface as well as act as an EMI stitch point. The system 180 may include a longitudinal member formed as a tube 182. The tube 182 may be formed from a metal mesh material. The interior of the tube 182 may include a top side and a bottom side. A magnet 184 of continuous length may be placed on the top side, and an anchoring support bar 186 is placed on the bottom side. The support bar 186 may be connected to a first housing component, as for example using flange portions that extend outside of the tube 182. The magnet 184 may be configured to be attracted to a ferromagnetic plate of continuous length on a second housing component. When the two housing components are assembled, the magnet 184 may be attracted to the ferromagnetic plate, which pulls the metal mesh across the seam found between the two housing components. This assembly helps hold the two components together, as well as provides an EMI seal across the seam (via the metal mesh). As shown in FIGS. 17B and 17C, the system 180 comes in a first state, shown in FIG. 17B, which provides slack in the metal mesh for movement into the second state, shown in FIG. 17C. It should be noted that this embodiment is not limited to continuous lengths, and incremental portions may be used. Furthermore, the magnet and ferromagnetic plate may be switched.

As can be seen from the foregoing, the advantages of the invention are numerous. Different embodiments or implementations may have one or more of the following advantages. One embodiment may utilize a moving part to eliminate tolerance deviations from adjacent or unique parts (absorbs geometric variation of two disparate parts). One embodiment may utilize magnetic attraction to produce a net neutral force on a housing wall. One embodiment may allow easy removal without having to worry about wires that couple subassemblies together (the subassemblies can remain separate). One embodiment may be extremely subtle and may enhance the identification of a product. One embodiment may be much less cumbersome than screws, adhesive, and the like. One embodiment may exhibit good strength characteristics and good contact between points (good seal). One embodiment may be used on complex housing shapes (curved forms).

While this invention has been described in terms of several preferred embodiments, there are alterations, permutations, and equivalents, which fall within the scope of this invention. By way of example, it is contemplated that other magnetic configurations can be used. For example, an electromagnet element can be included rather than a permanent magnet. It should also be noted that there are many other alternative ways of implementing the methods and apparatuses of the present invention. For example, constraining the internal component to a housing component may be advantageous, and the invention can also work with unconstrained internal components, for example, internal components that are not connected to or are free from a housing component. In these cases, the internal components may be sandwiched between two housing components. The housing components may include alignment features for helping maintain the proper relationship between all the components. For example, double chamfers on both sides of the internal component may be used. It is therefore intended that the following appended claims be interpreted as including all such alterations, permutations, and equivalents as fall within the true spirit and scope of the present invention.

What is claimed is:

1. An electronic device, comprising:

a first housing having an opening;

a second housing having a first mounting point, the second housing cooperating with the first housing to form an enclosure, and a functional component including at least one magnetic element, and being located internal to the enclosure, and being movably coupled to the first mounting point;

wherein the functional component magnetically couples with the first housing to movably align the functional component with the opening.

2. The electronic device of claim 1 wherein the opening and the first mounting point are aligned within a first tolerance range, and the functional component and the first mounting point are aligned within a second tolerance range, the movement of the functional component limited within the second tolerance range, and wherein the second tolerance range is greater than the first tolerance range.

3. The electronic device of claim 1 wherein the functional component is an electrical connector.

4. The electronic device of claim 1 wherein the functional component is an input/output device.

5. The electrical device of claim 1 wherein the at least one magnetic element includes a magnet.

6. The electrical device of claim 5 wherein the magnet is embedded in a flange.

7. The electrical device of claim 1 wherein the first housing includes at least one second magnetic element which magnetically couples with the at least one magnetic element.

8. The electrical device of claim 1 wherein the first housing includes a aligning element for automatically aligning the functional component with the opening.

9. The electrical device of claim 8 wherein the aligning element is a chamfered surface.

10. The electrical device of claim 1 wherein the functional component is accessible through the opening.

11. A method for assembling an electronic device, the method comprising:

coupling a functional component to a first housing, the functional component including at least one magnetic element, wherein the functional component is movable in relation to the first housing; and mounting a second housing to the first housing to form at least a portion of an enclosure of an electronic device, the enclosure at least partially enclosing the functional component, the second housing including an opening for the functional component, wherein the functional component magnetically couples with the second housing to automatically align with the opening.

12. The method of claim 11 wherein the opening of the second housing and the functional component are aligned within a first tolerance range, and the functional component and the first housing are aligned within a second tolerance range, the movement of the functional component limited within the second tolerance range, and wherein the second tolerance range is greater than the first tolerance range.

13. The method of claim 11 wherein the functional component is an electrical connector.

14. The method of claim 11 wherein the functional component is an input/output device.

15. The method of claim 11 wherein coupling the functional component to the first housing includes screwing the functional component to the internal housing.

16. The method of claim 11 wherein the magnetic element includes a magnet.

17. The method of claim 11 wherein the second housing includes at least one second magnetic element which magnetically couples with the at least one magnetic element.

18. A electronic device, comprising:

a first wall of an electronic device, the first wall including a wall opening;

an insert attached to the first wall, the insert including an insert opening aligned with the wall opening, the insert including a first aligning element at least partially surrounding the insert opening, the insert including at least one first magnetic element;

a second wall of an electronic device, the second wall and first wall forming at least a portion of an enclosure of an electronic device;

a connector base movably attached to the second wall, the connector base including at least one second magnetic element, the connector base including at least one second aligning element which aligns with the first aligning element; and a connector attached to the connector base, wherein the at least one second magnetic element magnetically couples with the at least one first magnetic element to move and automatically align the first and second aligning elements when the first and second walls form at least a portion of an enclosure.

19. The electronic device of claim 18 wherein the connector is accessible through the wall opening.

20. The electronic device of claim 18 wherein the wall opening is on at least a partially curved surface of the first wall.

21. The electronic device of claim 18 wherein the insert includes a lip which fits within the wall opening.

22. The electronic device of claim 18 wherein the insert include a flange portion which extend laterally away from the insert opening, the flange portion including the at least one first magnetic element.

23. The electronic device of claim 21 wherein the at least one first magnetic element is a ferromagnetic material.

24. The electronic device of claim 22 wherein the at least one second magnetic element is a magnet which couples to the ferromagnetic material.

25. The electronic device of claim 18 wherein the connector base is movably attached to the second outer wall through an at least one post of the second outer wall.

26. The electronic device of claim 25 wherein the connector base is movable within six degrees of freedom.

27. The electronic device of claim 18 wherein the first and second aligning elements included chamfered surfaces.

28. A connector system, comprising:

a first wall of an electronic device, the first wall including a wall opening on at least a partially curved portion of the first wall;

an insert attached to the first wall, the insert including an insert opening aligned with the wall opening by a lip, the insert including a first chamfered surface surrounding the insert opening, the insert including two flanged portions, each flanged portion including a ferromagnetic surface;

a second wall of an electronic device, the second wall and first wall forming at least a portion of an enclosure of an electronic device;

a connector base movably attached to a portion of the second wall, the connector base including at least one second magnetic element, the connector base including at second chamfered surface which aligns with the first chamfered surface; and a power connector including a magnetic attachment system for attaching to an external power cord, the power connector attached to the connector base, wherein the power connector is accessible through the insert opening through the curved portion of the first wall after the first and external walls form at least a portion of an enclosure, and wherein the magnets magnetically couple with the ferromagnetic surfaces to move and automatically align the first and second chamfered surfaces when the first and second walls form at least a portion of an enclosure, and wherein the opening of the insert and the connector base are aligned within a first tolerance range, and the connector base and the second wall are aligned within a second tolerance range, the movement of the connector base limited within the second tolerance range, and wherein the second tolerance range is greater than the first tolerance range.

* * * * *

UNITED STATES PATENT AND TRADEMARK OFFICE

CERTIFICATE OF CORRECTION

PATENT NO. : 7,762,817 B2
APPLICATION NO. : 12/239662
DATED : July 27, 2010
INVENTOR(S) : Chris Ligtenberg et al.

It is certified that error appears in the above-identified patent and that said Letters Patent is hereby corrected as shown below:

In column 6, line 12, delete “component” and insert -- internal component --, therefor.

In column 15, line 39, delete “the0” and insert -- the --, therefor.

Signed and Sealed this
Eighth Day of November, 2011

David J. Kappos

David J. Kappos
*Director of the United States Patent and Trademark Office*